US011427423B2

(12) United States Patent
Maeyama et al.

(10) Patent No.: US 11,427,423 B2
(45) Date of Patent: Aug. 30, 2022

(54) SHEET CONVEYING DEVICE AND IMAGE FORMING APPARATUS INCORPORATING THE SHEET CONVEYING DEVICE

(71) Applicants: Yuichiro Maeyama, Kanagawa (JP); Tomohiro Egawa, Kanagawa (JP); Motoharu Takahashi, Kanagawa (JP)

(72) Inventors: Yuichiro Maeyama, Kanagawa (JP); Tomohiro Egawa, Kanagawa (JP); Motoharu Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/205,493

(22) Filed: Nov. 30, 2018

(65) Prior Publication Data

US 2019/0161301 A1 May 30, 2019

(30) Foreign Application Priority Data

Nov. 30, 2017 (JP) ..... JP2017-230436
Nov. 26, 2018 (JP) ..... JP2018-220207

(51) Int. Cl.
*B65H 9/12* (2006.01)
*B65H 9/00* (2006.01)
(Continued)

(52) U.S. Cl.
CPC ..... *B65H 9/002* (2013.01); *B65H 5/062* (2013.01); *B65H 7/08* (2013.01);
(Continued)

(58) Field of Classification Search
CPC ..... B65H 9/002; B65H 9/106; B65H 9/18; B65H 9/20
See application file for complete search history.

(56) References Cited

U.S. PATENT DOCUMENTS 5,697,609 A * 12/1997 Williams ..... B65H 9/002 271/228
7,802,781 B2 * 9/2010 Iguchi ..... B26D 5/32 270/58.02
(Continued)

FOREIGN PATENT DOCUMENTS

JP 6-234441 8/1994
JP 9-175694 * 7/1997
(Continued)

OTHER PUBLICATIONS

Machine translation of JP9-175694. (Year: 1997).*

*Primary Examiner* — Thomas A Morrison
(74) *Attorney, Agent, or Firm* — Harness, Dickey & Pierce, P.L.C.

(57) ABSTRACT

A sheet conveying device, which is included in an image forming apparatus, includes a plurality of position detectors, a leading end detector, and a position adjuster. The plurality of position detectors is configured to detect a position of a sheet. The leading end detector is configured to detect a leading end of the sheet. The position adjuster is configured to, based on a detection result obtained by the plurality of position detectors, rotate in a rotation direction of the sheet within a plane of conveyance of the sheet to change the position of the sheet the position adjuster grips the sheet under conveyance to cause the leading end detector to rotate with the position adjuster in the rotation direction of the sheet within the plane of conveyance of the sheet.

41 Claims, 27 Drawing Sheets

(51) Int. Cl.
*B65H 7/08* (2006.01)
*B65H 5/06* (2006.01)

(52) U.S. Cl.
CPC ..... *B65H 2404/142* (2013.01); *B65H 2404/1424* (2013.01); *B65H 2404/14212* (2013.01); *B65H 2553/81* (2013.01); *B65H 2553/82* (2013.01); *B65H 2801/21* (2013.01)

(56) References Cited

U.S. PATENT DOCUMENTS

| | | | | |
|---|---|---|---|---|
| 9,834,399 | B1 * | 12/2017 | Hashimoto | B26D 1/015 |
| 10,392,213 | B2 * | 8/2019 | Matsuda | B65H 9/002 |
| 2016/0159598 | A1 * | 6/2016 | Yamane | B65H 9/002 271/227 |
| 2018/0162667 | A1 * | 6/2018 | Matsuda | B65H 9/20 |

FOREIGN PATENT DOCUMENTS

| | | |
|---|---|---|
| JP | 10-067448 | 3/1998 |
| JP | 10-120253 | 5/1998 |
| JP | 2003-302845 | 10/2003 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2010-149377 | 7/2010 |
| JP | 2011-098790 | 5/2011 |
| JP | 2016-108152 | 6/2016 |
| JP | 2016-175776 | 10/2016 |
| JP | 2017-088265 | 5/2017 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2017-230436, filed on Nov. 30, 2017, and 2018-220207, filed on Nov. 26, 2018, in the Japan Patent Office, the entire disclosure of each of which is hereby incorporated by reference herein.

BACKGROUND

Technical Field

This disclosure relates to a sheet conveying device that feeds a conveyance target medium and an image forming apparatus including the sheet conveying device.

Related Art

Various sheet conveying devices that convey a conveyance target medium are known to convey sheets such as papers and original documents in an image forming apparatus such as a copier and a printer.

In general, such sheet conveying devices are known that, when a sheet is conveyed to an image forming device or an image transfer device, the sheet under conveyance is abutted against a nip region of a pair of sheet conveying rollers that is stopped so as to correct an angular displacement of the sheet, and then the pair of sheet conveying rollers starts rotating at a predetermined timing to convey the sheet to a target position. However, a method of abutting the sheet to the nip region of the pair of sheet conveying rollers causes the sheet to stop temporarily, and therefore the productivity degrades (the image forming speed decreases).

In order to address this inconvenience and correct positional deviations of a sheet without degrading the productivity, a known sheet conveying device has been proposed that a pair of rollers is driven in a direction opposite to the direction of a positional deviation of the sheet while conveying the sheet so that the positional deviation of the sheet is corrected without stopping conveyance of the sheet.

However, a distance of sheet conveyance of the sheet with no skew, from a point at which the leading end of the sheet is detected by a skew detection sensor to a point at which the sheet reaches a target position, is different from a distance of sheet conveyance of the sheet with skew, and the relative positions of the skew detection sensor and the sheet changes. Consequently, if the sheet is conveyed at the same conveying speed with or without the skew, the timings of arrival of the sheet to the target position vary.

SUMMARY

At least one aspect of this disclosure provides a sheet conveying device including a plurality of position detectors, a leading end detector, and a position adjuster. The plurality of position detectors is configured to detect a position of a sheet. The leading end detector is configured to detect a leading end of the sheet. The position adjuster is configured to, based on a detection result obtained by the plurality of position detectors, rotate in a rotation direction of the sheet within a plane of conveyance of the sheet to change the position of the sheet while the position adjuster grips the sheet under conveyance to cause the leading end detector to rotate with the position adjuster in the rotation direction of the sheet within the plane of conveyance of the sheet.

Further, at least one aspect of this disclosure provides an image forming apparatus including the above-described sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
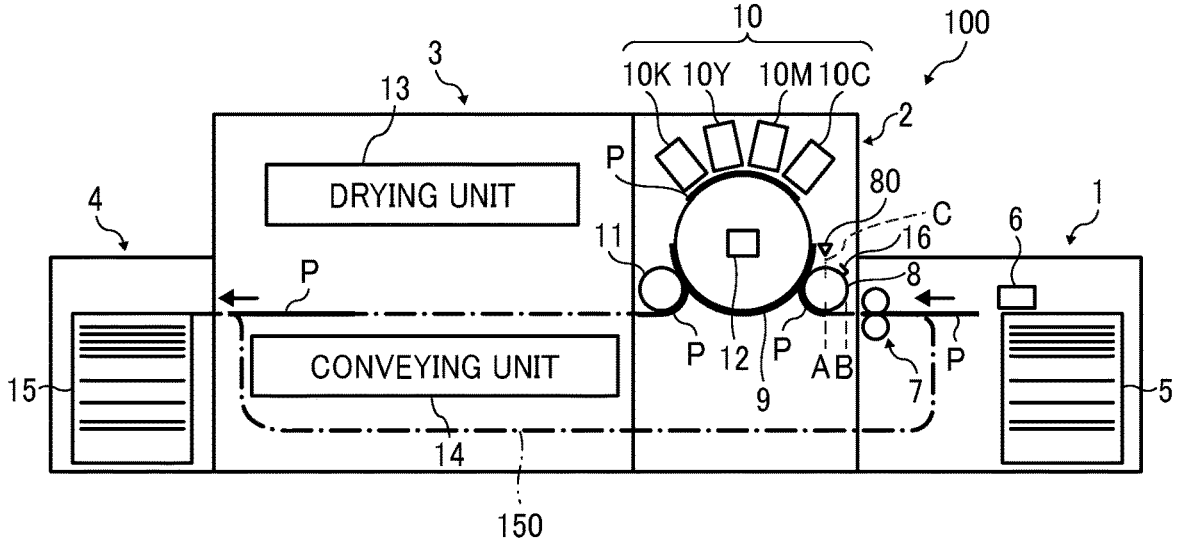
FIG. 1 is a diagram illustrating a schematic configuration of an inkjet image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device and an image forming apparatus incorporating the sheet conveying device.

It is to be noted that elements (for example, mechanical parts and components) having the same functions and shapes are denoted by the same reference numerals throughout the specification and redundant descriptions are omitted.

FIG. 1 is a diagram illustrating a schematic configuration of an inkjet image forming apparatus 100 according to an embodiment of this disclosure.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an inkjet printer that forms toner images on recording media with ink.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Overall Configuration

The inkjet type image forming apparatus 100 according to the present embodiment mainly includes a sheet feeding device 1, an image forming device 2, a drying device 3, and a sheet output device 4. In the inkjet type image forming apparatus 100, an image is formed by ink, which is a liquid for image formation, in the image forming device 2 on a sheet P as a sheet supplied from the sheet feeding device 1. Then, after the ink adhered on the sheet P is dried in the drying device 3, the sheet P is discharged from the sheet output device 4.

Further, when performing a duplex printing operation, after the image is formed on the front face of the sheet P in the image forming device 2, the sheet is dried by the drying device 3, and the sheet P is not discharged but is conveyed to a sheet reverse and conveyance passage 150. By passing through the sheet reverse and conveyance passage 150, the sheet P is reversed in the sheet reverse and conveyance passage 150 and conveyed to the image forming device 2 again. After an image is formed on a back face of the sheet P in the image forming device 2, the sheet P is dried in the drying device 3, and is discharged from the sheet output device 4.

Sheet Feeding Device

The sheet feeding device 1 mainly includes a sheet feed tray 5, a sheet feeder 6 and a sheet conveying device 7. The sheet feed tray 5 is a sheet loader on which multiple sheets P are loaded thereon. The sheet feeder 6 separates and feeds the multiple sheets P one by one from the sheet feed tray 5. The sheet conveying device 7 conveys the sheet P to the image forming device 2. The sheet feeder 6 may be a sheet feeding unit that includes rollers, a sheet feeding unit employing an air suction method, and any other sheet feeding units. The sheet P fed from the sheet feed tray 5 by the sheet feeder 6 is conveyed to the image forming device 2 by the sheet conveying device 7.

Image Forming Device

The image forming device 2 mainly includes a transfer cylinder 8, a sheet holding drum 9, an ink discharging device 10 and a transfer cylinder 11. The transfer cylinder 8 functions as a first conveyance rotary body to receive and transfer the fed sheet P to the sheet holding drum 9. The sheet holding drum 9 functions as a second conveyance rotary body to hold and convey the sheet P conveyed by the transfer cylinder 8 on an outer circumferential surface thereof. The ink discharging device 10 discharges ink toward the sheet P held by the sheet holding drum 9. The transfer cylinder 11 functions as a third conveyance rotary body to transfer the sheet P conveyed by the sheet holding drum 9 to the drying device 3.

After the sheet P is conveyed from the sheet feeding device 1 to the image forming device 2, a gripper 16 that is rotatable as a handle mounted on a surface of the transfer cylinder 8 grips the leading end of the sheet P, so that the sheet P is conveyed along with the surface movement of the transfer cylinder 8. The sheet P conveyed by the transfer cylinder 8 is transferred to the sheet holding drum 9 at an opposing position where the sheet P is brought to face the sheet holding drum 9.

A gripper similar to the gripper 16 on the transfer cylinder 8 is provided on the surface of the sheet holding drum 9, so that the leading end of the sheet P is gripped by the gripper on the sheet holding drum 9. Multiple air drawing openings are dispersedly formed on the surface of the sheet holding drum 9, and a suction airflow directing toward the inside of the sheet holding drum 9 by an air drawing device 12 is generated at each air drawing opening. The leading end of the sheet P that is transferred from the transfer cylinder 8 to the sheet holding drum 9 is gripped by the gripper. At the same time, the sheet P is sucked on the surface of the sheet holding drum 9 due to the suction airflow and is conveyed along with the surface movement of the sheet holding drum 9.

The ink discharging device 10 according to the present embodiment includes liquid discharging heads 10C, 10M, 10Y and 10K having different colors of C (cyan), M (magenta), Y (yellow), and K (black), respectively, to form an image. The configuration of the liquid discharging heads 10C, 10M, 10Y and 10K is not limited thereto and any other configuration may be applied as long as each liquid discharging head ejects liquid. Another liquid discharging head that ejects special ink such as white, gold and silver may be added to the ink discharging device 10 or yet another liquid discharging head that ejects a surface coating liquid that does not form an image may be provided to the ink discharging device 10.

Respective discharging operations of the liquid discharging heads 10C, 10M, 10Y and 10K of the ink discharging device 10 are individually controlled by respective drive signals according to image data. When a sheet P held by the sheet holding drum 9 passes by an opposing region facing the ink discharging device 10, respective color inks are discharged from the liquid discharging heads 10C, 10M, 10Y and 10K, so that an image is formed according to the image data. It is to be noted that, in the present embodiment, the image forming device 2 is not limited thereto and any other configuration may be applied as long as the configuration is to form an image by supplying and adhering liquid onto the sheet P.

Drying Device

The drying device 3 mainly includes a drying unit 13 and a sheet conveying unit 14. The drying unit 13 dries ink that is adhered on the sheet P in the image forming device 2. The sheet conveying unit 14 coveys the sheet P that is conveyed from the image forming device 2. The sheet P conveyed from the image forming device 2 is received by the sheet conveying unit 14. Then, the sheet P is conveyed to pass by the drying unit 13 and is transferred to the sheet output device 4. When passing through the drying unit 13, the ink on the sheet P is subjected to a drying process. By so doing, the liquid content such as moisture in the ink is evaporated, and therefore the ink is fixed onto the sheet P and curling of the sheet P is restrained.

Sheet Output Device

The sheet output device 4 mainly includes a sheet output tray 15 onto which multiple sheets P are output and stacked. The sheets P that are sequentially conveyed from the drying device 3 are overlaid one after another and stacked. It is to be noted that the configuration of the sheet output device 4 according to the present embodiment is not limited thereto and any other configuration may be applied as long as the sheet output device discharges the sheet P or the multiple sheets P.

Other Additional Functional Devices

As described above, the inkjet type image forming apparatus 100 according to the present embodiment includes the sheet feeding device 1, the image forming device 2, the drying device 3 and the sheet output device 4. However, other functional devices may be added appropriately. For example, the inkjet type image forming apparatus 100 may further include a pre-processing device between the sheet feeding device 1 and the image forming device 2 to perform pre-processing operations of image formation. The inkjet type image forming apparatus 100 may further include a post processing device between the drying device 3 and the sheet output device 4 to perform post processing operations of image formation.

An example of the pre-pre-processing device performs a processing liquid applying operation to apply processing liquid onto the sheet P so as to reduce bleeding by reacting with ink. However, the content of the pre-processing operation is not limited particularly. Further, as an example of the post processing device performs sheet reversing and conveying operations to reverse the sheet P having an image formed thereon in the image forming device 2 and convey the sheet P to the image forming device 2 again to form images on both sides of the sheet P or performs a binding operation to bind the multiple sheets P having respective images thereon. However, the content of the post processing operation is not limited particularly.

It is to be noted that the term "image" to be formed on a sheet is not limited to visible significant images such as texts and figures but includes, for example, patterns that themselves have no meaning. In addition, the term "sheet" on which the image is formed is not limited to limited materials but may include any object to which liquid can be temporarily attached, for example, paper, thread, fiber, cloth, leather, metal, plastic, glass, wood and ceramics, or any object to be used for film products, cloth products such as clothing, building materials such as wallpaper and flooring materials and leather products. The term "liquid" is not particularly limited as long as the liquid has a viscosity and a surface tension that can be discharged from the liquid discharging head. However, but it is preferable that the liquid has a viscosity of 30 mPa·s or less at normal temperature and normal pressure or by heating and cooling. More specifically, the liquid includes a solvent such as water or an organic solvent, a solution including a coloring agent such as a dye or a pigment, a functionalizing material such as a polymerizable compound, a resin or a surfactant, a biocompatible material such as DNA, amino acid, protein or calcium, edible materials such as natural pigments, or suspension or emulsion. These liquids can be used for ink for inkjet printing and surface treatment liquid, for example.

In addition, the term "inkjet type image forming apparatus" indicates an apparatus in which liquid discharging head(s) and a sheet material move relatively but is not limited thereto. An example of the inkjet type image forming apparatus includes a serial type image forming apparatus in which the liquid discharging head moves and a line type image forming apparatus in which the liquid discharging head does not move.

Further, the term "liquid discharging head" indicates a functional component that discharges and ejects liquid from liquid discharging holes (nozzles). As an energy generation source for discharging liquid, a discharging energy generating device, e.g., a piezoelectric actuator (stacked piezoelectric element and thin film piezoelectric element), a thermal actuator using an electrothermal transducer such as a heating resistor, and an electrostatic actuator including a diaphragm and a counter electrode, can be used. However, the discharging energy generating device to be used is not limited.

Next, a description is given of the sheet conveying device 7 included in the sheet feeding device 1 of the inkjet type image forming apparatus 100 according to the present embodiment of this disclosure.

Figure 2:
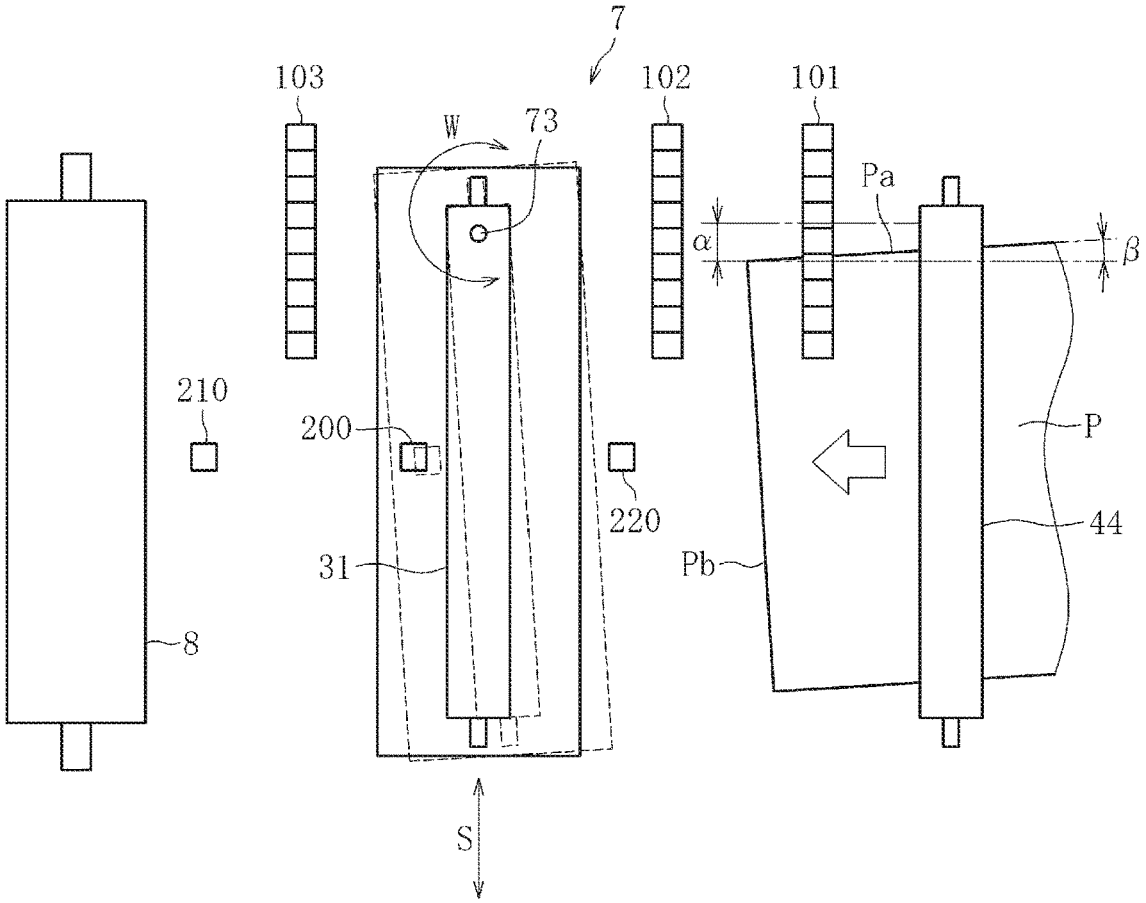
FIG. 2 is a diagram illustrating a sheet conveying device according to the present embodiment of this disclosure.

FIG. 2 is a diagram illustrating the sheet conveying device 7 according to the present embodiment of this disclosure.

As illustrated in FIG. 2, the sheet conveying device 7 includes three CISs, which are the first CIS 101, the second CIS 102 and the third CIS 103, three leading end detection sensors, which are a first leading end detection sensor 200, a second leading end detection sensor 210, and an upstream side leading end detection sensor 220, and a pair of sheet holding rollers 31. The first CIS 101, the second CIS 102 and the third CIS 103 function as position detectors to detect the position of the sheet P. Each of the first leading end detection sensor 200, the second leading end detection sensor 210, and the upstream side leading end detection sensor 220 functions as a leading end detector to detect the leading end of the sheet P. The pair of sheet holding rollers 31 functions as a position adjuster to adjust the position of the sheet P while holding the sheet P under conveyance. In the following description, the first CIS 101 that functions as a first position detector, the second CIS 102 that functions as a second position detector, and the third CIS 103 that functions as a third position detector are disposed from an upstream side to a downstream side of the sheet conveying direction of the sheet P. Further, the first leading end detection sensor 200 and the second leading end detection sensor 210 are disposed downstream from the pair of sheet holding rollers 31 in the sheet conveying direction. The first leading end detection sensor 200 is disposed on an upstream side and functions as a first leading end detector. The second leading end detection sensor 210 is disposed on a downstream side and functions as a second leading end detector. The upstream side leading end detection sensor 220 is disposed upstream from the pair of sheet holding rollers 31 in the sheet conveying direction and functions as a third leading end detector.

The "CIS" stands for a contact image sensor that contributes to a reduction in size of a device in recent years. The CIS uses small-size LEDs (light emitting diodes) as light sources to directly read an image by linear sensors via lenses. Each of the first CIS 101, the second CIS 102 and the third CIS 103 includes multiple line sensors aligned in the width direction of the sheet P so as to detect a side edge Pa of one end side in the width direction of the sheet P. Specifically, the first CIS 101 and the second CIS 102 are disposed at the upstream side from the pair of sheet holding rollers 31 and at the downstream side from the pair of sheet conveying rollers 44 that is disposed at one upstream position from the pair of sheet holding rollers 31. By contrast, the third CIS 103 is disposed at the downstream side from the pair of sheet holding rollers 31 and at the upstream side from the transfer cylinder 8. The first CIS 101, the second CIS 102 and the third CIS 103 are disposed parallel to each other relative to the width direction of the sheet P (i.e., a direction perpendicular to the sheet conveying direction).

Each of the first leading end detection sensor 200, the second leading end detection sensor 210, and the upstream side leading end detection sensor 220 includes a reflective optical sensor. By detecting the leading end portion Pb of the sheet P, the first leading end detection sensor 200, the second leading end detection sensor 210, and the upstream side leading end detection sensor 220 detect the conveyance timing at which the sheet P reaches the position of each of the first leading end detection sensor 200, the second leading end detection sensor 210, and the upstream side leading end detection sensor 220. The first leading end detection sensor 200 is disposed downstream from the pair of sheet holding rollers 31 and upstream from the third CIS 103 in the sheet conveying direction. The second leading end detection sensor 210 is disposed downstream from the third CIS 103 and upstream from the transfer cylinder 8 in the sheet conveying direction. The upstream side leading end detection sensor 220 is disposed upstream from the pair of sheet holding rollers 31 and downstream from the second CIS 102 in the sheet conveying direction.

The pair of sheet holding rollers 31 moves in the width direction (i.e., in a direction indicated by arrow S in FIG. 2) of the sheet P while holding the sheet P under conveyance and rotates about the support shaft 73 within a plane of sheet conveyance (i.e., in a direction indicate by arrow W in FIG. 2). By so doing, the pair of sheet holding rollers 31 changes (adjusts) the position of the sheet P. As a result, the lateral displacement $\alpha$ of the sheet P and the angular displacement $\beta$ of the sheet P are corrected. In other words, the pair of sheet holding rollers 31 also functions as a positional deviation correcting unit to correct the angular and lateral displacements of the sheet P. In the present embodiment, the support shaft 73 is provided on the one end side in the axial direction of the pair of sheet holding rollers 31. However, the position of the support shaft 73 is not limited thereto. For example, the support shaft 73 may be provided at the axial center position of the pair of sheet holding rollers 31.

Figure 3:
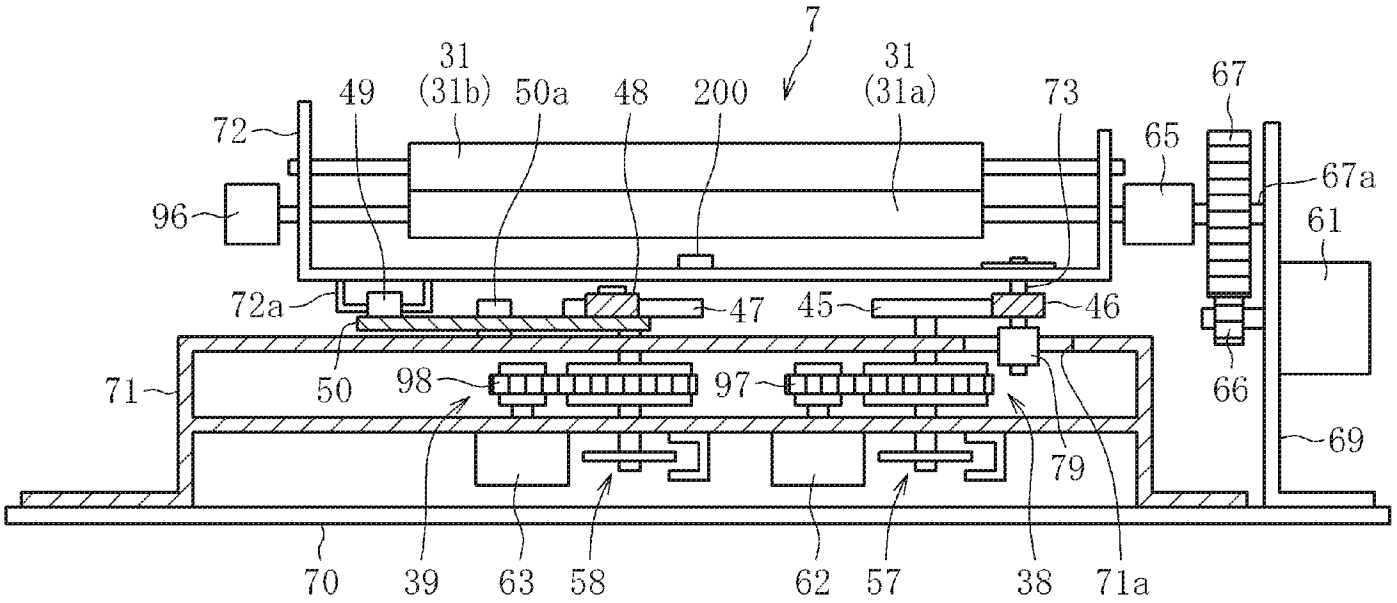
FIG. 3 is a side view illustrating a driving mechanism to drive a pair of sheet holding rollers.
Figure 4:
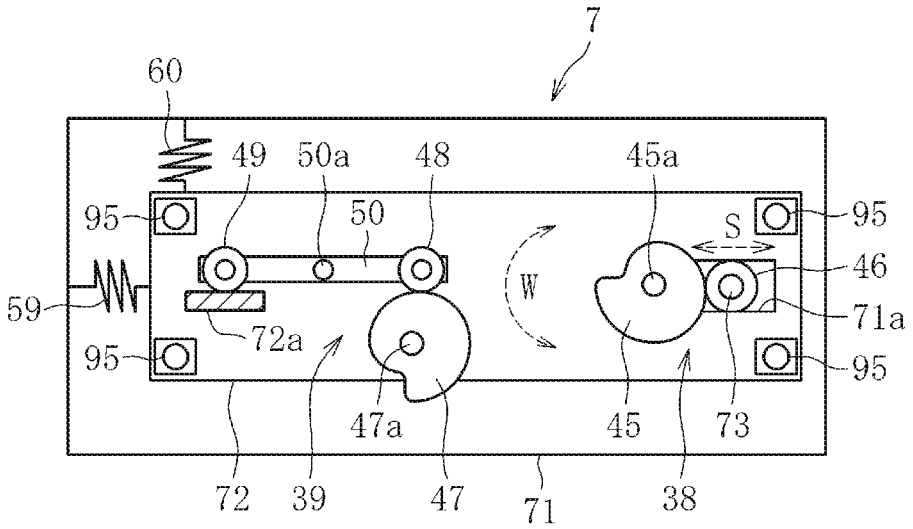
FIG. 4 is a plan view illustrating the driving mechanism to drive the pair of sheet holding rollers.

FIGS. 3 and 4 are diagrams illustrating the pair of sheet holding rollers 31 and a driving mechanism to drive the pair of sheet holding rollers 31. FIG. 3 is a side view illustrating the driving mechanism and FIG. 4 is a plan view illustrating the driving mechanism.

As illustrated in FIG. 3, the pair of sheet holding rollers 31 includes a drive roller 31*a* and a driven roller 31*b*. The drive roller 31*a* drivingly rotates about a roller shaft thereof. The driven roller 31*b* is rotated along with rotation of the drive roller 31*a*. The pair of sheet holding rollers 31 is rotatably held or supported by a holder frame 72 that functions as a holding body to rotate about the roller shaft. The holder frame 72 is supported by a base frame 71 fixed to a body frame 70 of the inkjet type image forming apparatus 100.

As illustrated in FIG. 4, the holder frame 72 is mounted on the base frame 71 via free bearings (ball transfers) 95 that function as a relay support. As a result, the holder frame 72 is movable in any direction within a plane of sheet conveyance (within a plane of conveyance of a conveyance target medium) along the upper surface of the base frame 71. As described above, by supporting the holder frame 72 using the free bearings 95, the friction load generated when the holder frame 72 moves can be made extremely small. Accordingly, the correction of the angular and lateral displacements of the sheet P, which is described below, is performed at high speed and with high accuracy. In the present embodiment, the holder frame 72 is supported by the four free bearings 95. However, the number of the free bearings 95 is not limited thereto. For example, the number of the free bearings 95 may be three or more.

Further, as illustrated in FIG. 3, the holder frame 72 includes the support shaft 73 that is as a rotation center of the pair of sheet holding rollers 31 within a plane of sheet conveyance that is provided to extend downwardly. The lower end portion of the support shaft 73 is inserted into a lateral guide portion 71*a* formed in the base frame 71. The lateral guide portion 71*a* is an opening or a hole portion formed so as to extend substantially linearly in the width direction (i.e., the direction indicated by arrow S in FIG. 4). Further, a guide roller 79 is rotatably provided at the lower end portion of the support shaft 73. The support shaft 73 is inserted so as to contact the lateral guide portion 71*a* via the guide roller 79. As the support shaft 73 moves in the width direction along the lateral guide portion 71*a*, the holder frame 72 and the pair of sheet holding rollers 31 that is held or supported by the holder frame 72 also move in the width direction. Further, the holder frame 72 also rotates around the support shaft 73 within a plane of sheet conveyance (in the direction indicated by arrow W in FIG. 4). As the holder frame 72 rotates around the support shaft 73, the pair of sheet holding rollers 31 rotates within a plane of sheet conveyance.

As illustrated in FIG. 3, a bracket 69 is provided on the right end side of the body frame 70 and a conveyance drive motor (a conveyance drive unit) 61 is provided on the bracket 69 to apply a driving force to convey a sheet to the pair of sheet holding rollers 31. The conveyance drive motor 61 and the drive roller 31*a* of the pair of sheet holding rollers 31 are coupled via a gear train including multiple gears 66 and 67 and a coupling mechanism 65. The coupling mechanism 65 is a two-step spline coupling. Even if the rotary shaft of the drive roller 31*a* and the rotary shaft of the gear 67 are separated or approached in the axial direction from each other or driven in a direction in which these rotary shafts are inclined with respect to each other, the coupling mechanism 65 holds the connection so that the driving force can be transmitted. Since the drive roller 31*a* and the gear 67 are coupled via the coupling mechanism 65 as described above, the pair of sheet holding rollers 31 moves in the width direction or rotates within a plane of sheet conveyance. Accordingly, even when a relative position of the drive roller 31*a* and the conveyance drive motor 61 is changed, the drive force transmission from the conveyance drive motor 61 to the drive roller 31*a* is preferably performed.

Further, as illustrated in FIG. 3, a rotary encoder 96 is mounted at the end portion of the drive roller 31*a* (i.e., at an end portion on the opposite side from the conveyance drive motor 61). The rotary encoder 96 functions as a rotation speed detector to detect the conveyance rotation speed of the drive roller 31*a* (or the conveyance drive motor 61). The conveyance rotation speed of the pair of sheet holding rollers 31 is controlled based on the detection result of the rotary encoder 96.

Further, the sheet conveying device 7 according to the present embodiment includes a lateral driving mechanism 38 and an angular driving mechanism 39. The lateral driving mechanism 38 causes the holder frame 72 and the pair of sheet holding rollers 31 to move in the width direction. The angular driving mechanism 39 causes the holder frame 72 and the pair of sheet holding rollers 31 to rotate within a plane of sheet conveyance.

As illustrated in FIGS. 3 and 4, the lateral driving mechanism 38 includes a lateral drive motor (a lateral drive body) 62, a timing belt 97, a cam 45 and a tension spring 59. The tension spring 59 is connected to the holder frame 72 and the base frame 71 so as to bias the holder frame 72 in one direction (i.e., the left direction in FIG. 4) in the width direction. The cam 45 is held by the base frame 71 to be rotatable about a rotary shaft 45*a*. Further, the cam 45 is held in contact with a cam follower 46 provided on the support shaft 73 by the biasing force of the tension spring 59. As the cam 45 rotates, the cam follower 46 is pushed against the biasing force applied by the tension spring 59. Accordingly, the holder frame 72 moves in the width direction (i.e., the right direction in FIG. 4).

Further, as illustrated in FIG. 3, the timing belt 97 is wound around the rotary shaft 45*a* of the cam 45 and the motor shaft of the lateral drive motor 62. As a result, the driving force is transmitted from the lateral drive motor 62 to the cam 45 via the timing belt 97. Further, a rotary encoder 57 is mounted on the rotary shaft 45*a* of the cam 45. The rotary encoder 57 functions as a rotation angle detector to detect the rotation angle (rotation amount) of the cam 45. By controlling the driving of the lateral drive motor 62 based on the detection result of the rotary encoder 57, the rotation angle of the cam 45 is controlled, and the amount of movement of the holder frame 72 in the width direction is adjusted. That is, the rotary encoder 57 functions as a drive position detector that detects a drive position when the holder frame 72 and the pair of sheet holding rollers 31 move in the width direction.

As illustrated in FIGS. 3 and 4, the angular driving mechanism 39 includes an angular drive motor (angular drive body) 63, a timing belt 98, a cam 47, a tension spring 60 and a lever 50. The tension spring 60 is connected to the holder frame 72 and the base frame 71 so as to bias the holder frame 72 in one direction (i.e., a clockwise direction around the support shaft 73 in FIG. 4) of the rotational (angular) direction. The cam 47 is provided on the base frame 71 so as to be rotatable around a rotary shaft 47*a* thereof. In addition, the cam 47 is held in contact with a cam follower 48 provided at one end of the lever 50 by the biasing force of the tension spring 60. An action roller 49 is rotatably provided at an end portion on the opposite side of the lever 50. The action roller 49 is held in contact with a projection 72*a* provided to the holder frame 72 by the biasing force of the tension spring 60. With the above-described configuration, when the cam 47 rotates and the cam follower 48 is pushed by the cam 47, the lever 50 rotates about a rotary shaft 50*a* thereof. Along with this operation, the action roller 49 provided on the lever 50 pushes the projection 72*a* of the holder frame 72 against the biasing force of the tension spring 60, so that the holder frame 72 rotates within a plane of sheet conveyance (in a counter-clockwise direction in FIG. 4).

Further, as illustrated in FIG. 3, a timing belt 98 is wound around the rotary shaft 47*a* of the cam 47 and the motor shaft of the angular drive motor 63. According to this configuration, the driving force is transmitted from the angular drive motor 63 to the cam 47 via the timing belt 98. Further, a rotary encoder 58 is mounted on the rotary shaft 47*a* of the cam 47. The rotary encoder 58 functions as a rotation angle detector to detect the rotation angle (rotation amount) of the cam 47. By controlling the driving of the angular drive motor 63 based on the detection result of the rotary encoder 58, the rotation angle of the cam 47 is controlled, and the number of rotations of the holder frame 72 in the within a plane of sheet conveyance is adjusted. That is, the rotary encoder 58 functions as a drive position detector that detects a drive position when the holder frame 72 and the pair of sheet holding rollers 31 rotate within a plane of sheet conveyance.

Figure 5A:
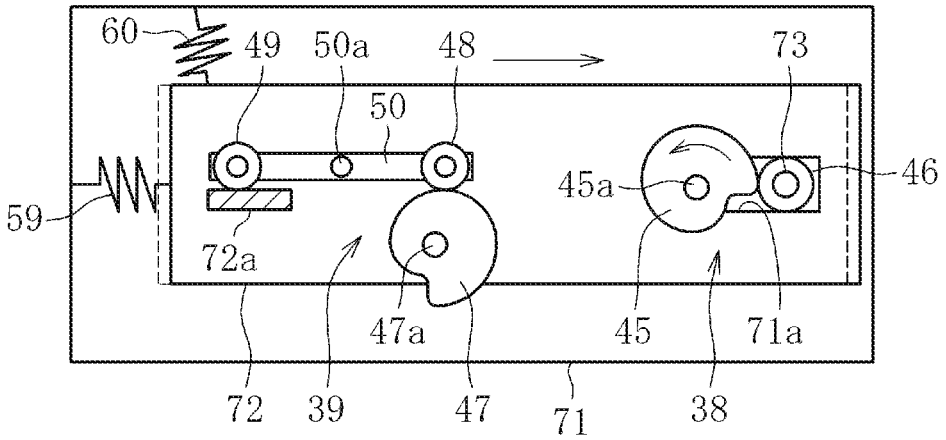
FIG. 5A is a diagram illustrating a state in which a support frame has moved in the width direction.
Figure 5B:
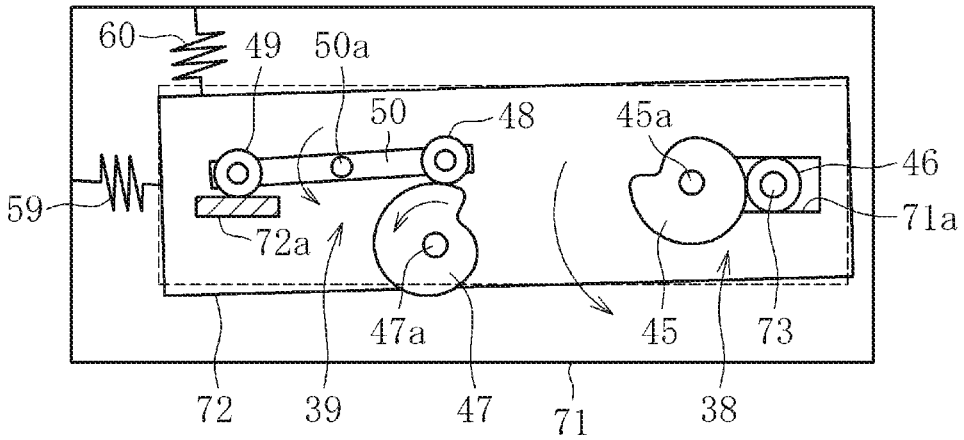
FIG. 5B is a diagram illustrating a state in which the support frame has removed in the rotational direction within a plane of sheet conveyance.
Figure 5C:
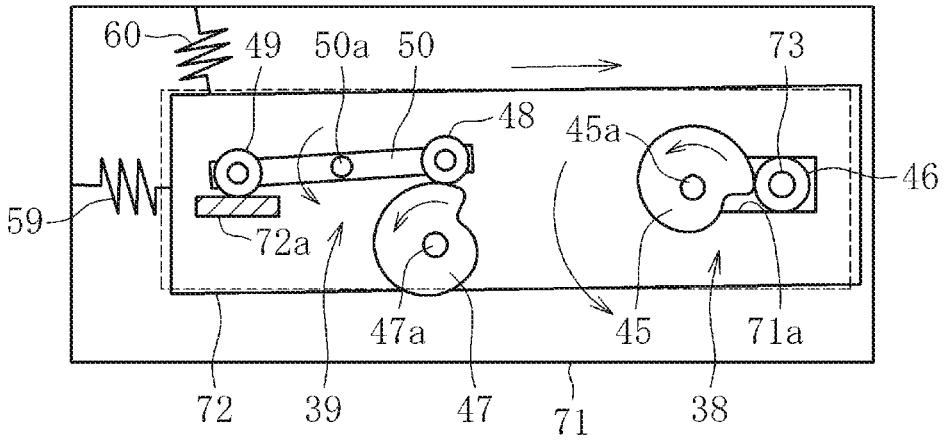
FIG. 5C is a diagram illustrating a state in which the support frame has moved in the width direction and the rotational direction within a plane of sheet conveyance.

FIG. 5A is a diagram illustrating a state in which the cam 45 of the lateral driving mechanism 38 has rotated and the holder frame 72 has moved in the width direction. FIG. 5B is a diagram illustrating a state in which the cam 47 of the angular driving mechanism 39 has rotated and the holder frame 72 has rotated within a plane of sheet conveyance. FIG. 5C is a diagram illustrating a state in which both the cam 45 and the cam 47 has rotated and the holder frame 72 has moved in the width direction and rotated within a plane of sheet conveyance.

Further, as illustrated in FIG. 3, the first leading end detection sensor 200 is provided on the holder frame 72. Accordingly, when the holder frame 72 moves in the width direction or rotates within a plane of sheet conveyance as described above, the first leading end detection sensor 200 moves (integrally) together with the holder frame 72 in the width direction or within a plane of sheet conveyance. By contrast, the second leading end detection sensor 210 and the upstream side leading end detection sensor 220 are fixed so as not to move onto the sheet conveyance passage.

It is to be noted that, in the present embodiment, the first leading end detection sensor 200 is located at the center in the width direction of the sheet P (i.e., at the axial center of the pair of sheet holding rollers 31) and the support shaft 73 is provided on one end side in the width direction of the sheet P (i.e., on one end side in the axial direction of the pair of sheet holding rollers 31). However, the positions of the first leading end detection sensor 200 and the support shaft 73 are not limited thereto. For example, both the first leading end detection sensor 200 and the support shaft 73 may be provided at the center in the width direction of the sheet P (i.e., at the axial center of the pair of sheet holding rollers 31) or may be provided on one end side in the width direction of the sheet P (i.e., on one end side in the axial direction of the pair of sheet holding rollers 31). It is to be noted that, when the sheet P has an angular displacement, if the first leading end detection sensor 200 is located closer to the center of rotation of the pair of sheet holding rollers 31, i.e., closer to the support shaft 73, the holder frame 72 can be less affected by the positional deviation of the sheet P.

Figure 6:
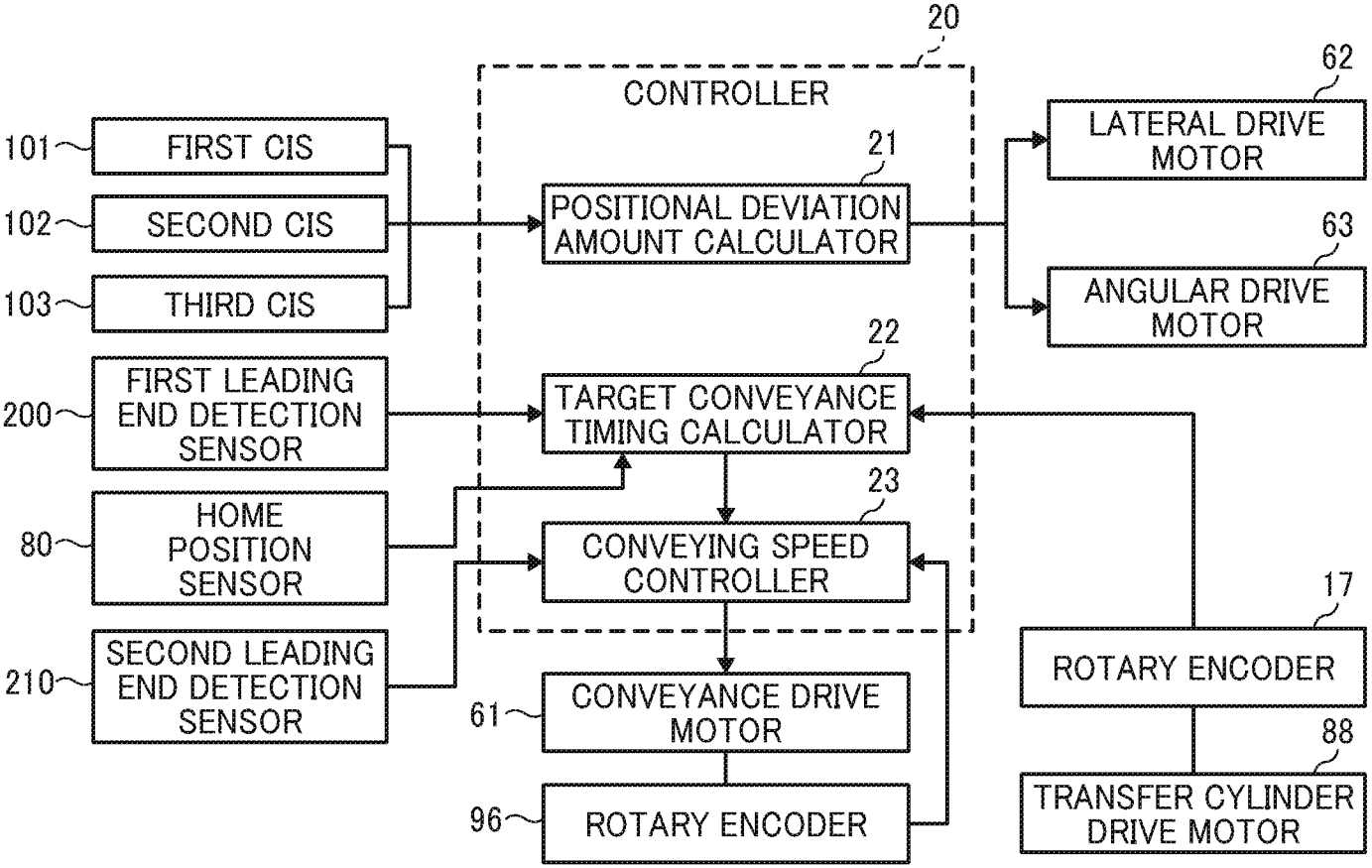
FIG. 6 is a block diagram illustrating a control system of the sheet conveying device according to the present embodiment of this disclosure.

FIG. 6 is a block diagram illustrating a control system of the sheet conveying device 7 according to the present embodiment of this disclosure.

As illustrated in FIG. 6, the sheet conveying device 7 according to the present embodiment includes a controller 20 that functions as circuitry individually controls the conveyance drive motor 61 that applies a driving force to convey a sheet to the pair of sheet holding rollers 31, the lateral drive motor 62 that causes the pair of sheet holding rollers 31 to move in the width direction, and the angular drive motor 63 that causes the pair of sheet holding rollers 31 to rotate within a plane of sheet conveyance. That is, the controller 20 controls the conveyance rotation speed, the movement amount in the width direction and the rotation amount within a plane of sheet conveyance of the pair of sheet holding rollers 31.

The controller 20 includes a positional deviation amount calculator 21, a target conveyance timing calculator 22 and a conveying speed controller 23 that also functions as circuitry. The positional deviation amount calculator 21 calculates an amount of positional deviation of a sheet based on the detection results of the first CIS 101, the second CIS 102 and the third CIS 103. The target conveyance timing calculator 22 calculates a target conveyance timing of a sheet to a predetermined target position. The target conveyance timing calculator 22 receives a signal sent from a rotary encoder 17 that functions as a rotation speed detector to detect the conveyance rotation speed of the transfer cylinder 8 that is driven by a transfer cylinder drive motor 88. Specifically, the target conveyance timing calculator 22 calculates the target conveyance timing of a sheet based on the detection result of the first leading end detection sensor 200 and the detection result of a home position sensor 80 (occasionally, a HP sensor 80) (see FIG. 1) provided on the transfer cylinder 8 or based on the detection result (the signal) of the second leading end detection sensor 210 and the detection result (the signal) of the rotary encoder 17 that functions as a rotation speed detector to detect the conveyance rotation speed of the transfer cylinder 8. The conveying speed controller 23 controls a conveying speed (i.e., the conveyance rotation speed of the pair of sheet holding rollers 31) of a sheet based on the target conveyance timing calculated by the target conveyance timing calculator 22. The conveying speed controller 23 also adjusts the conveying speed based on information of the rotary encoder 96 to detect the conveyance rotation speed of the pair of sheet holding rollers 31 and the detection result of the second leading end detection sensor 210.

For example, the controller 20 may be implemented using hardware, a combination of hardware and software, or a non-transitory storage medium storing software that is executable to perform the functions of the same. For example, in some example embodiments, the controller 20 may include a memory and a processing circuitry. The memory may include a nonvolatile memory device, a volatile memory device, a non-transitory storage medium, or a combination of two or more of the above-mentioned devices. The processing circuitry may be, but not limited to, a processor, Central Processing Unit (CPU), a controller, an arithmetic logic unit (ALU), a digital signal processor, a microcomputer, a field programmable gate array (FPGA), an Application Specific Integrated Circuit (ASIC), a System-on-Chip (SoC), a programmable logic unit, a microprocessor, or any other device capable of performing operations in a defined manner. The processing circuitry may be configured, through a layout design and/or execution of computer readable instructions stored in a memory, as a special purpose computer to perform the functions of the positional deviation amount calculator 21, the target conveyance timing calculator 22 and/or the conveying speed controller 23.

In other example embodiments, the controller 20 may include integrated circuit (IC) specially customized into special purpose processing circuitry (e.g., an ASIC) to perform the functions of the positional deviation amount calculator 21, the target conveyance timing calculator 22 and/or the conveying speed controller 23.

In the present embodiment, the sheet P is to reach a sheet gripping position A (see FIG. 1) on the transfer cylinder 8 that rotates at constant speed, at the same timing as an arrival timing of the gripper 16 mounted on the transfer cylinder 8, arriving at the sheet gripping position A. The timing at which the gripper 16 reaches the sheet gripping position A may be specified by detecting a rotation reference position C of the transfer cylinder 8 by the home position sensor 80. It is to be noted that, even though the transfer cylinder 8 in the present embodiment includes one gripper (i.e., the gripper 16), two or more grippers may be provided to the transfer cylinder 8. Further, in the present embodiment, the sheet P is adjusted to the same speed each time at a target position B (see FIG. 1) slightly before (near the upstream side) from the sheet gripping position A. Thereafter, the sheet P is conveyed to reach the sheet gripping position A at constant speed. Therefore, in the present embodiment, the timing at which the sheet P reaches this target position B is set as the target conveyance timing. As described above, in the present embodiment, a speed adjustment complete position at which the conveying speed of the sheet P is completely adjusted is set as the target position B. However, in a case in which the sheet P is not conveyed at constant speed, to a final target conveyance position such as the sheet gripping position A, the final target conveyance position may be the target position B. The calculated target conveyance timing may be, for example, the time from when the leading end portion Pb of the sheet P is detected by the first leading end detection sensor 200 to when the sheet P reaches the target position B at a predetermined timing or may be the conveyance rotation speed of the pair of sheet holding rollers 31 that enables the sheet P to reach the target position B within this time.

In order to address this inconvenience and correct positional deviations such as an angular displacement of a sheet without degrading the productivity, a comparative sheet conveying device corrects a positional deviation without stopping conveyance of the sheet by driving a pair of rollers in a direction opposite to the direction of the positional deviation of the sheet while conveying the sheet.

Figure 28:
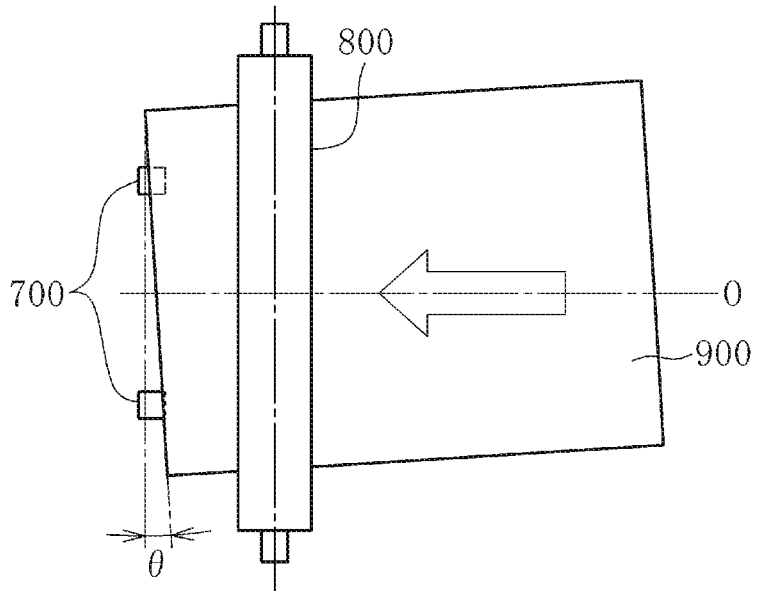
FIG. 28 is a plan view of a comparative sheet conveying device.
Figure 29:
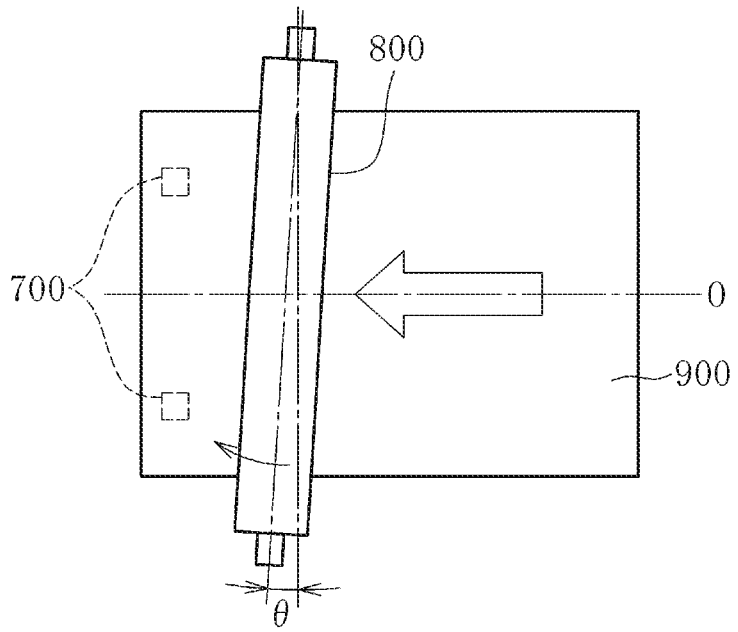
FIG. 29 is a plan view of the comparative sheet conveying device.

Specifically, as illustrated in FIG. 28, the comparative sheet conveying device detects the leading end of a sheet 900 by skew detection sensors 700 aligned in a direction perpendicular to a sheet conveying direction indicated by arrow O, and an angular displacement amount θ of the sheet 900 based on the detection result. Then, as illustrated in FIG. 29, by rotating a pair of sheet conveying rollers (a pair of registration rollers) according to the calculated angular displacement amount θ, the positional deviation (i.e., the angular displacement amount) of the sheet 900 is corrected.

Figure 30:
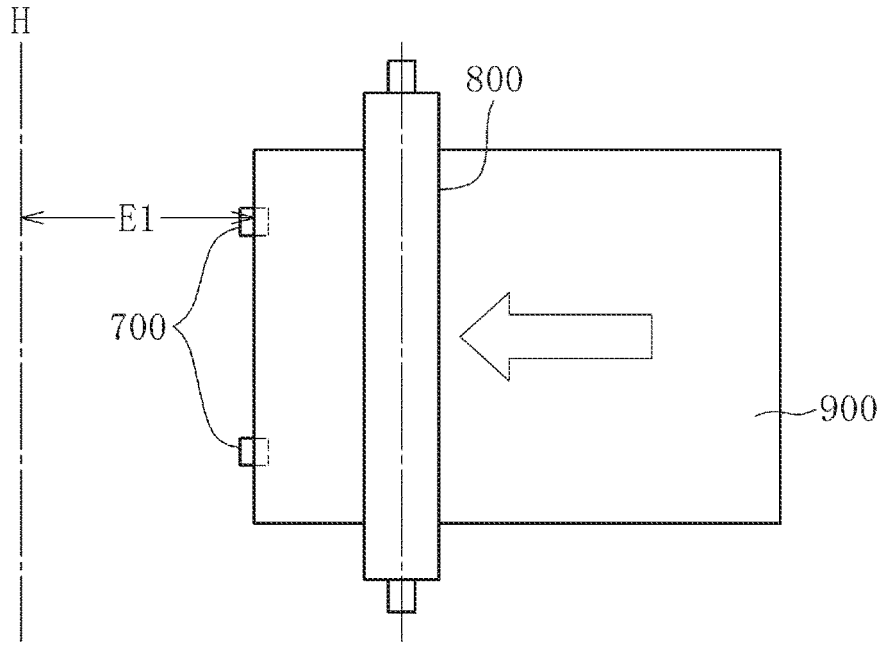
FIG. 30 is a diagram illustrating a sheet conveyance distance of movement of a sheet from a sheet leading end detection timing when the sheet has no angular displacement to a sheet arrival timing at a target position in the comparative sheet conveying device.
Figure 31:
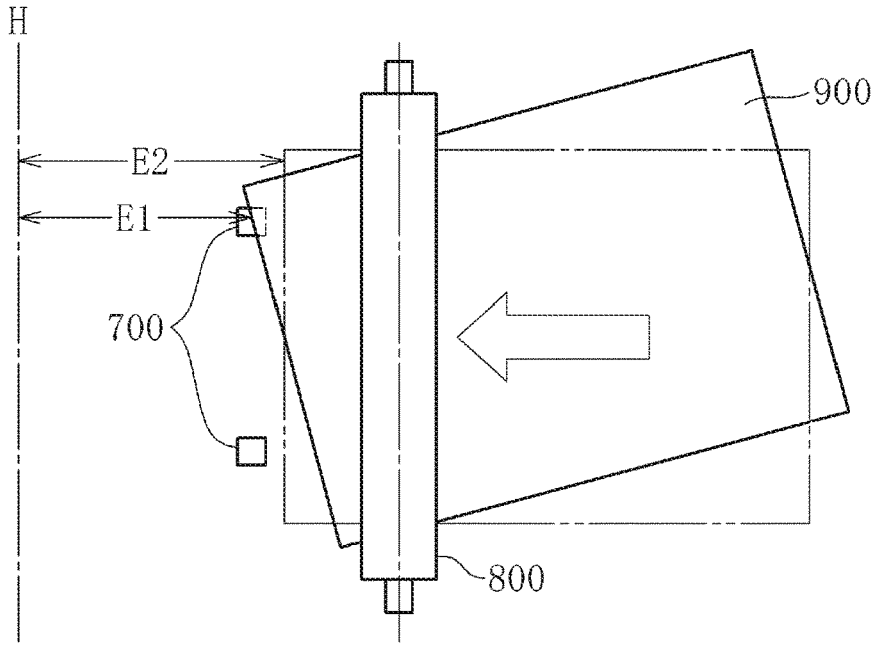
FIG. 31 is a diagram illustrating a sheet conveyance distance of movement of a sheet from the sheet leading end detection timing when the sheet has an angular displacement to the sheet arrival timing at a target position in the comparative sheet conveying device.

As illustrated in FIG. 30, when the sheet 900 is conveyed without any skew (i.e., any angular displacement), a distance of sheet conveyance from a point at which the leading end of the sheet 900 is detected by the skew detection sensors 700 to a point at which the sheet 900 reaches a target position H is a sheet conveyance distance E1. By contrast, as illustrated in FIG. 31, when the sheet 900 is conveyed with skew, the pair of sheet conveying rollers 800 is inclined to correct the skew of the sheet 900. By so doing, the relation of relative positions of the skew detection sensors 700 and the sheet 900 changes. Therefore, a distance of sheet conveyance from the point at which the leading end of the sheet 900 is detected by the skew detection sensors 700 to the point at which the sheet 900 reaches the target position H changes from the sheet conveyance distance E1 to a sheet conveyance distance E2. Consequently, if the sheet is conveyed at the same conveying speed with or without the skew, the timings of arrival of the sheet to the target position vary.

Therefore, when the skew of the sheet is corrected, the comparative sheet conveying device calculates the deviation of the sheet conveyance timing along with the correction of the positional deviation of the sheet and adjusts the conveying speed of the sheet based on the calculation result.

Figure 7:
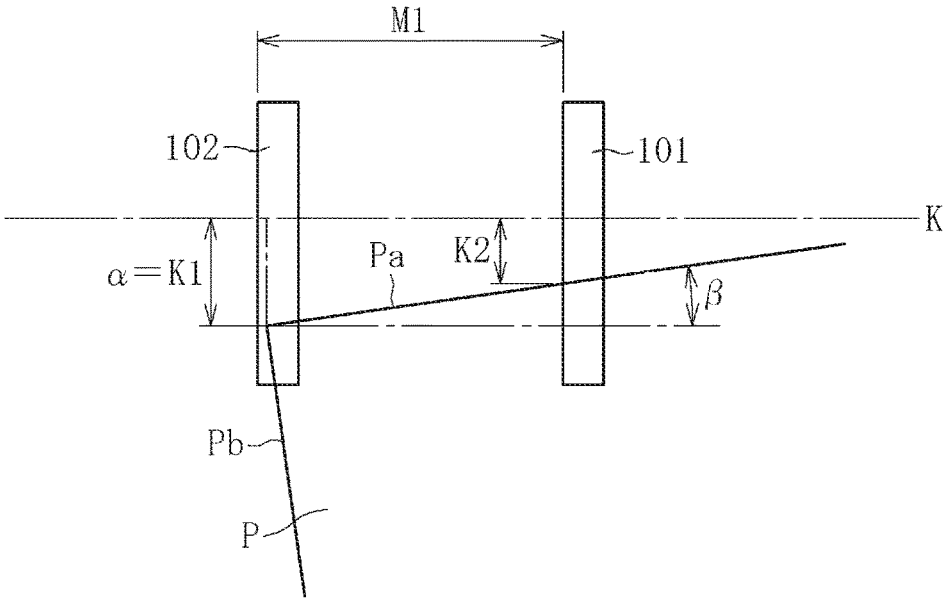
FIG. 7 is a diagram illustrating a position of the sheet for calculating a positional deviation amount of the sheet based on position information of the sheet obtained by using two CISs.
Figure 8:
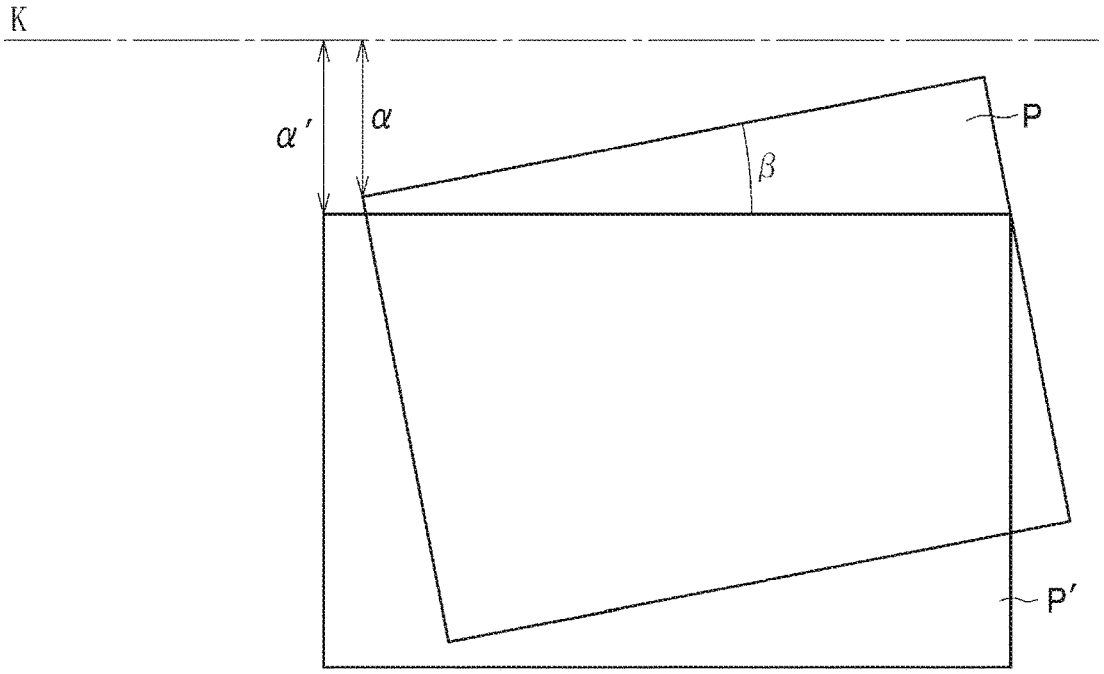
FIG. 8 is a diagram for explaining a lateral displacement amount of a sheet.

Here, a description is given of a method of calculating angular and lateral displacement amounts of a sheet, with reference to FIGS. 7 and 8. It is to be noted that a method of calculating a positional deviation amount, that is, angular and lateral displacement amounts of a sheet using the first CIS 101 and the second CIS 102 is illustrated in FIG. 7. However, the method is not limited thereto. For example, a method of calculating angular and lateral displacement amounts of a sheet using the second CIS 102 and the third CIS 103 may also be applied to this disclosure.

As illustrated in FIG. 7, when the leading end Pb of the sheet P passes the first CIS 101 and reaches the second CIS 102, the lateral displacement amount $\alpha$ of the sheet P and the angular displacement amount $\beta$ of the sheet P are detected.

Specifically, the lateral displacement amount $\alpha$ of the sheet P is calculated based on a position in the width direction of the sheet P detected by the second CIS 102 (i.e., a position of the side edge Pa of the sheet P). That is, the position in the width direction detected by the second CIS 102 is compared with the conveyance reference position K. Consequently, a distance K1 extending between the position of the sheet P and the reference conveyance position K is calculated as a lateral displacement amount $\alpha$ of the sheet P.

Further, the angular displacement amount $\beta$ of the sheet P is calculated based on a difference of end positions in the width direction of the sheet P detected by the first CIS 101 and the second CIS 102. That is, as illustrated in FIG. 7, at the moment when the leading end Pb of the sheet P reaches the second CIS 102, the distance K1 and a distance K2 in the width direction from the reference conveyance position K are detected by the first CIS 101 and the second CIS 102, respectively. Consequently, since a distance M1 in the sheet conveying direction between the first CIS 101 and the second CIS 102 is previously determined, the angular displacement amount $\beta$ to the sheet conveying direction of the sheet P is obtained based on an equation of $\tan \beta=(K1-K2)/M1$.

As described above, the lateral displacement amount $\alpha$ of the sheet P and the angular displacement amount $\beta$ of the sheet P are calculated It is to be noted that, as illustrated in FIG. 8, after the angular displacement $\beta$ has been corrected, as the position of the sheet P changes to a sheet P', the lateral displacement amount $\alpha$ of the sheet P changes to a lateral displacement amount $\alpha'$ of the sheet P'. Therefore, by previously calculating the lateral displacement amount $\alpha'$ of the sheet P', the lateral displacement $\alpha$ of the sheet P is corrected with higher accuracy. However, the lateral displacement amount $\alpha'$ of the sheet P' varies depending on a reference position of the correction of the angular displacement $\beta$.

Figure 14A:
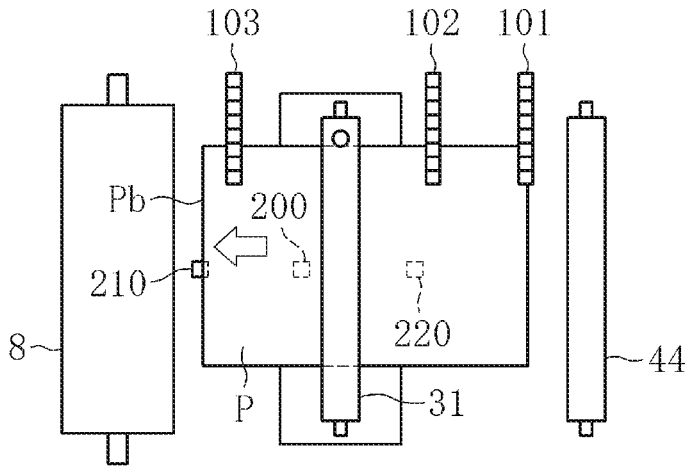
FIG. 14A is a plan view illustrating movement of the sheet conveying device according to the present embodiment of this disclosure.
Figure 14B:
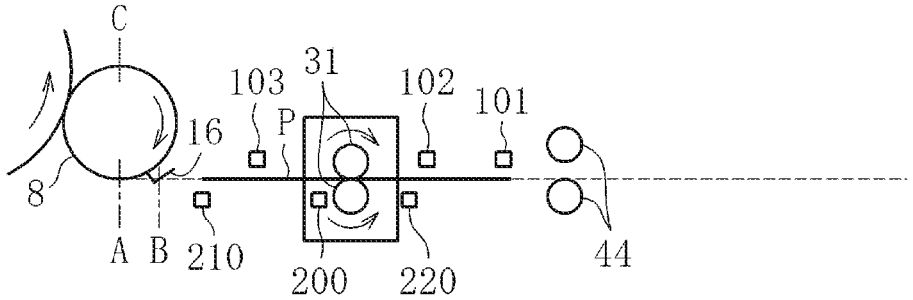
FIG. 14B is a side view illustrating the movement of the sheet conveying device of FIG. 14A.
Figure 15A:
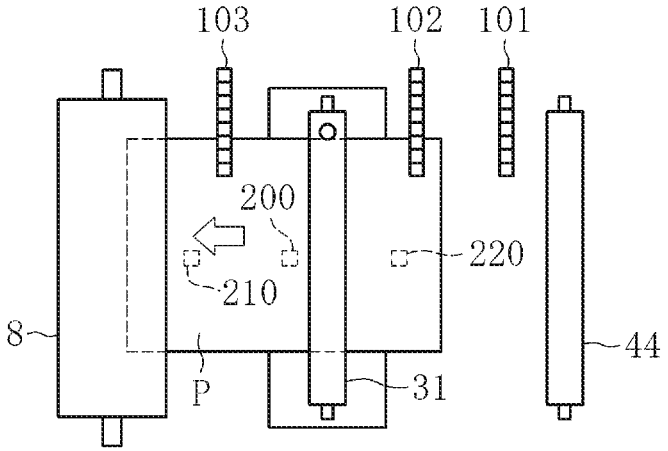
FIG. 15A is a plan view illustrating movement of the sheet conveying device according to the present embodiment of this disclosure.
Figure 15B:
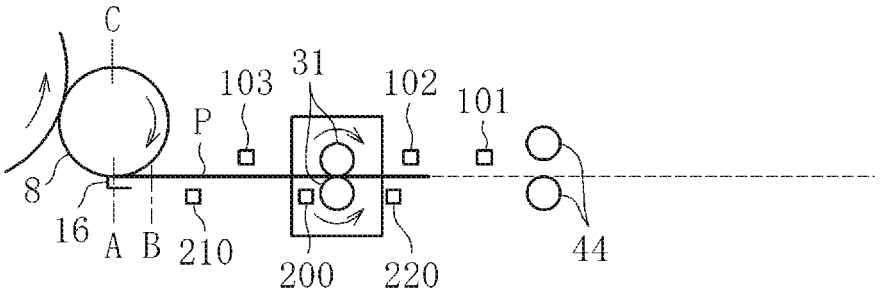
FIG. 15B is a side view illustrating the movement of the sheet conveying device of FIG. 15A.
Figure 16:
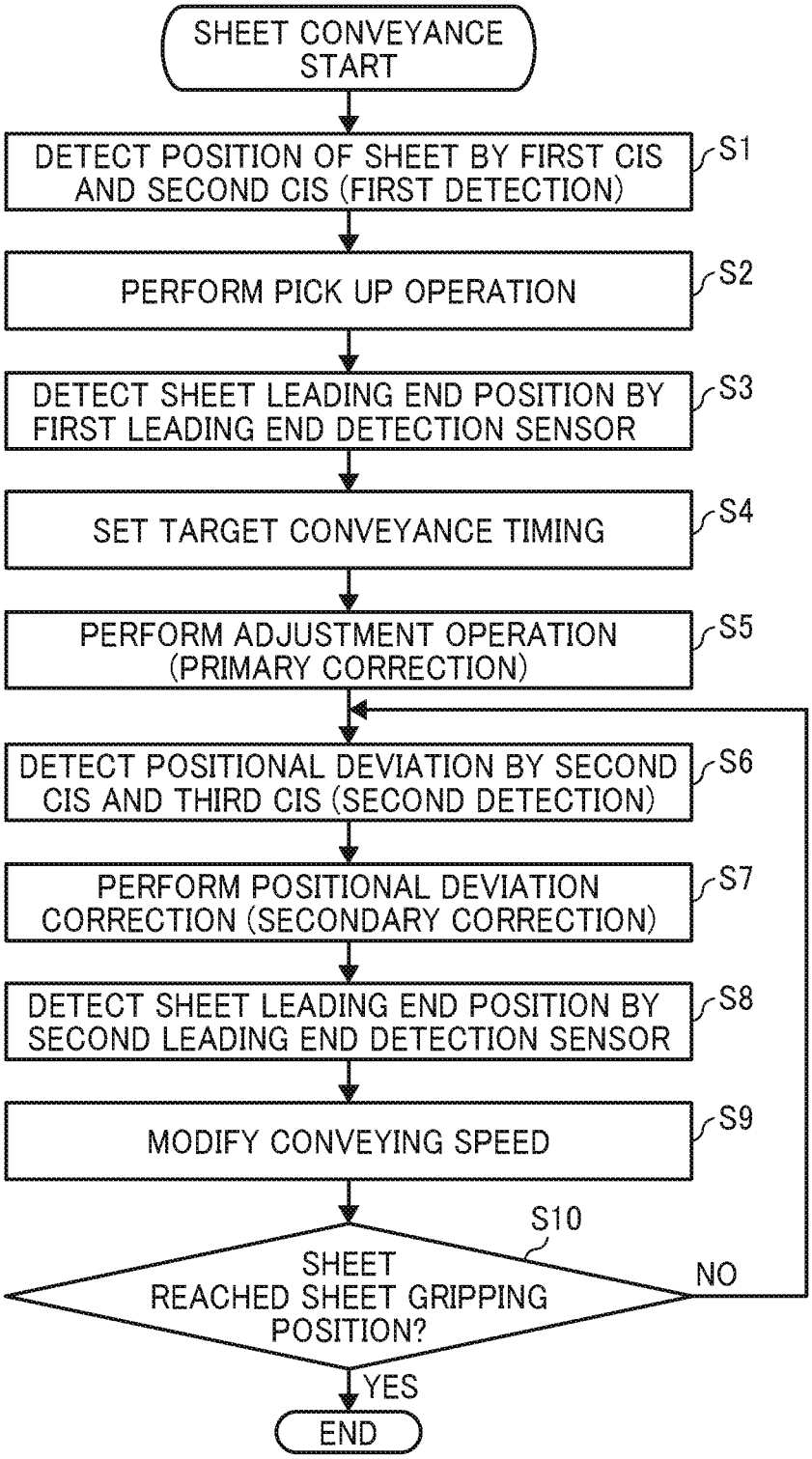
FIG. 16 is a flowchart of the sheet conveying device according to the present embodiment of this disclosure.

Next, a description is given of the operations of the sheet conveying device 7 according to the present embodiment, with reference to the plan views and side views of FIGS. 9A through 15B and the flowchart of FIG. 16.

Figure 9A:
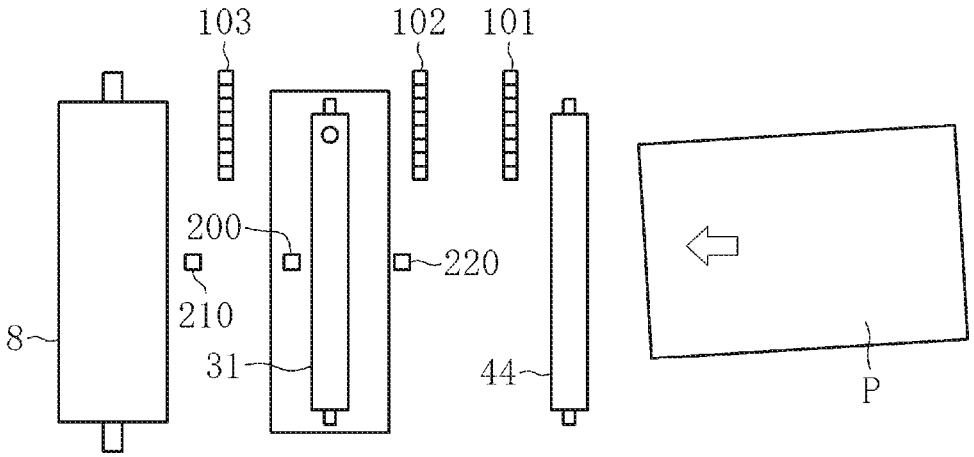
FIG. 9A is a plan view illustrating movement of the sheet conveying device according to the present embodiment of this disclosure.
Figure 9B:
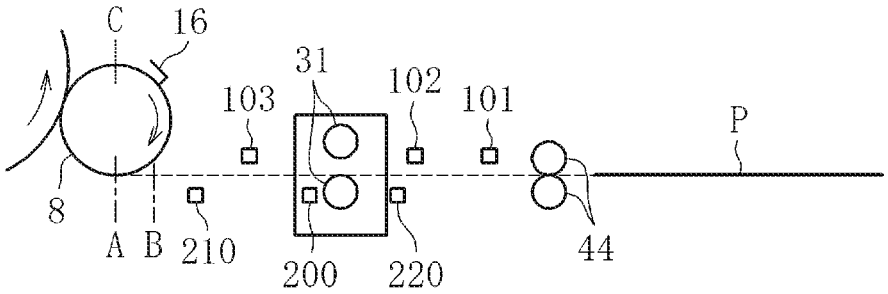
FIG. 9B is a side view illustrating the movement of the sheet conveying device of FIG. 9A.

As illustrated in FIGS. 9A and 9B, when the sheet P is conveyed, the pair of sheet holding rollers 31 is located at a home position at which the roller shaft of the pair of sheet holding rollers 31 extends in a direction perpendicular to the sheet conveying direction (i.e., in the left and right directions in FIGS. 9A and 9B). Further, in this state, the two rollers (i.e., the drive roller 31*a* and the driven roller 31*b*) of the pair of sheet holding rollers 31 are separated from each other and remains in a stationary state.

Figure 10A:
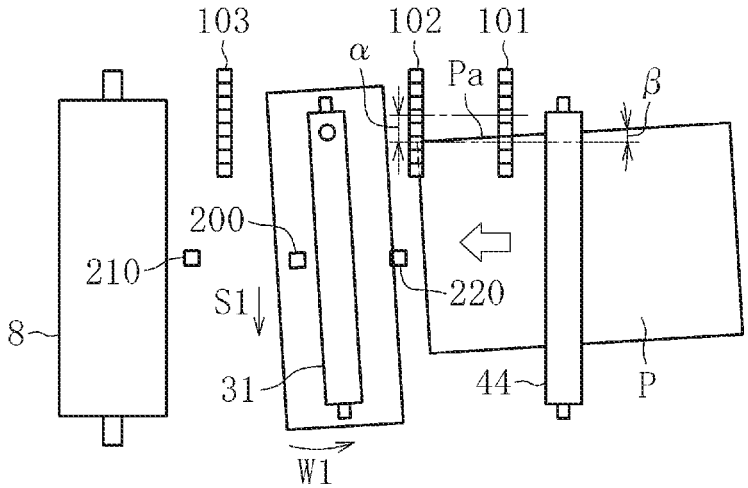
FIG. 10A is a plan view illustrating movement of the sheet conveying device according to the present embodiment of this disclosure.
Figure 10B:
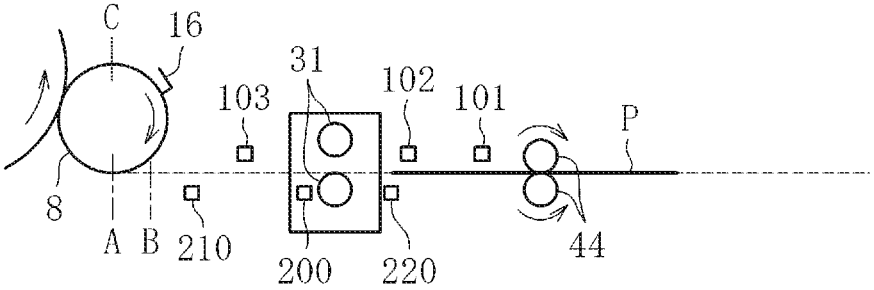
FIG. 10B is a side view illustrating the movement of the sheet conveying device of FIG. 10A.

Thereafter, as illustrated in FIGS. 10A and 10B, when the leading end portion Pb of the sheet P passes by the first CIS 101 and reaches the second CIS 102, the first CIS 101 and the second CIS 102 perform a "first positional detection" to detect the position of the side end portion Pa of the sheet P (step S1 in the flowchart of FIG. 16). Then, the positional deviation amount calculator 21 (see FIG. 6) calculates the lateral displacement amount $\alpha$ (or the lateral displacement amount $\alpha'$ together with the angular displacement amount $\beta$) based on the position information detected by the first CIS 101 and the second CIS 102. Then, based on the calculated positional deviation amount, the lateral drive motor 62 and the angular drive motor 63 are controlled to move the pair of sheet holding rollers 31 in the width direction (i.e., in the direction indicated by arrow S1 in FIG. 10A) and rotate within a plane of sheet conveyance (i.e., in the direction indicated by arrow W1 in FIG. 10A. As a result, the pair of sheet holding rollers 31 performs a pick up operation in which the pair of sheet holding rollers 31 moves to face leading end Pb of the sheet P (step S2 in the flowchart of FIG. 16).

Figure 11A:
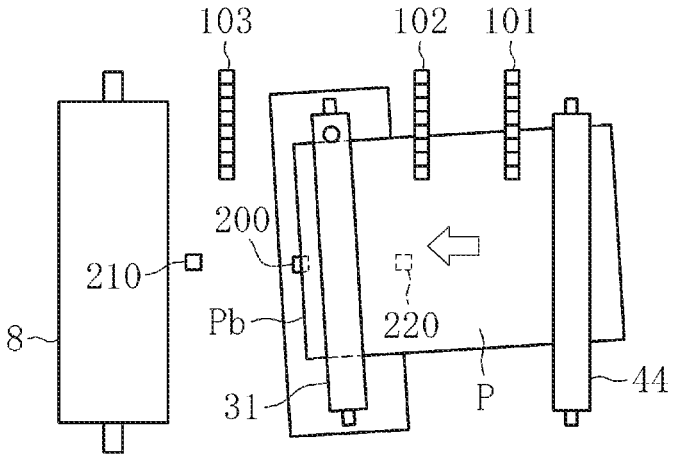
FIG. 11A is a plan view illustrating movement of the sheet conveying device according to the present embodiment of this disclosure.
Figure 11B:
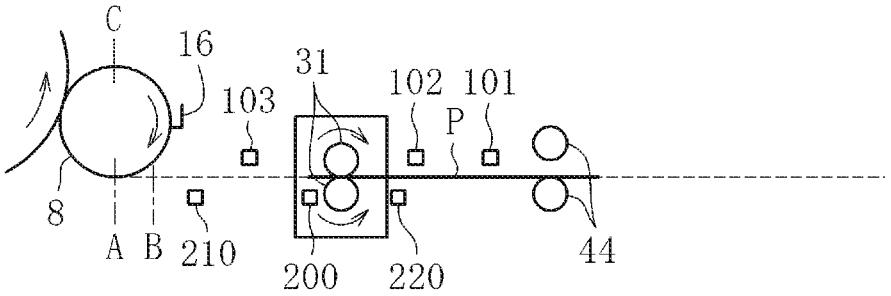
FIG. 11B is a side view illustrating the movement of the sheet conveying device of FIG. 11A.

Then, the leading end portion Pb of the sheet P is detected by the upstream side leading end detection sensor 220, and based on the detection timing, the rollers of the pair of sheet holding rollers 31 come into contact with each other and start the conveying rotations. Thereafter, as illustrated in FIGS. 11A and 11B, the sheet P is picked up by the pair of sheet holding rollers 31 that faces the sheet P, and the sheet P is conveyed while being held or gripped by the pair of sheet holding rollers 31. It is to be noted that, at the moment the pair of sheet holding rollers 31 receives (grips) the sheet P, the rollers of the pair of sheet conveying rollers 44 disposed upstream from the pair of sheet holding rollers 31 in the sheet conveying direction are separated.

Further, as illustrated in FIGS. 11A and 11B, as the sheet P is conveyed by the pair of sheet holding rollers 31 and the leading end Pb of the sheet P reaches the position of the first leading end detection sensor 200, a "first timing detection" in which the first leading end detection sensor 200 detects the leading end Pb of the sheet P is performed (step S3 in the flowchart of FIG. 16). According to this operation, the timing at which the leading end Pb of the sheet P reaches the first leading end detection sensor 200 is detected. Then, based on the detection result of the first leading end detection sensor 200 and the detection result of the home position sensor 80 of the transfer cylinder 8, the target conveyance timing of the sheet P to the predetermined target position B is calculated by the target conveyance timing calculator 22 (see FIG. 6) to be set (step S4 in the flowchart of FIG. 16).

Figure 12A:
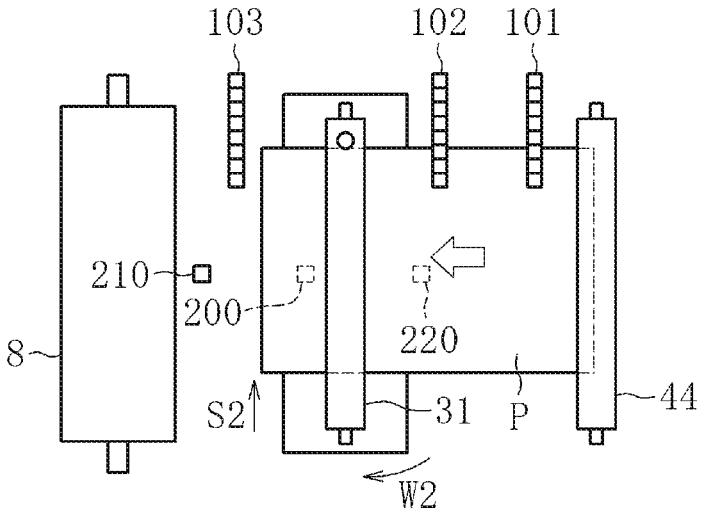
FIG. 12A is a plan view illustrating movement of the sheet conveying device according to the present embodiment of this disclosure.
Figure 12B:
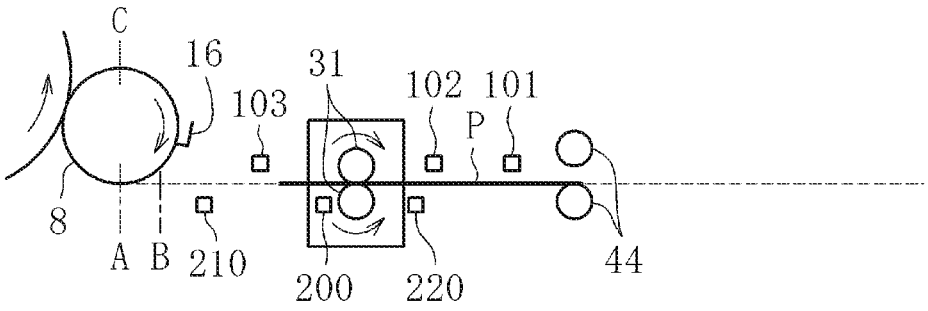
FIG. 12B is a side view illustrating the movement of the sheet conveying device of FIG. 12A.

Thereafter, as illustrated in FIGS. 12A and 12B, while holding and conveying the sheet P, the pair of sheet holding rollers 31 performs an adjustment operation to move in directions (i.e., the direction indicated by arrow S2 and the direction indicated by arrow W2 in FIG. 12A) that are opposite to the directions of the pick up operation (step S5 in the flowchart of FIG. 16). As a result, a "primary correction" in which the lateral displacement of the sheet P and the angular displacement of the sheet P are corrected is performed.

It is to be noted that step S5 in which the adjustment operation (i.e., the primary correction) is performed is illustrated after step S3 in which the first leading end detection sensor 200 performs the first timing detection in the flowchart of FIG. 16. However, the adjustment operation (i.e., step S5) may be performed prior to the first timing detection (i.e., step S3) immediately after the pick up operation in step S2.

Figure 13A:
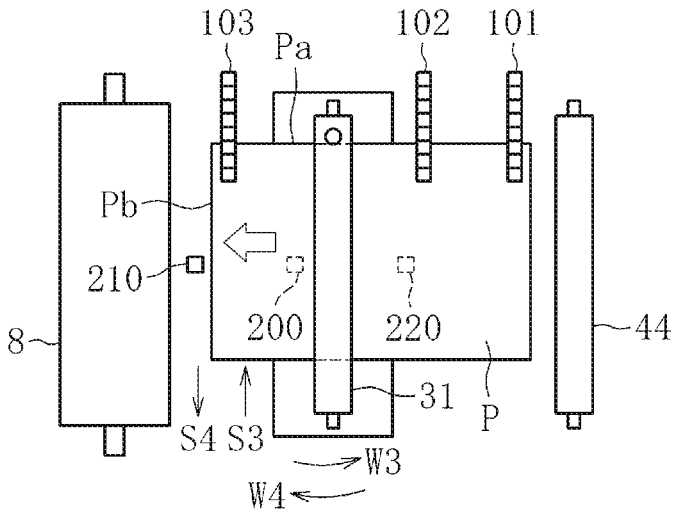
FIG. 13A is a plan view illustrating movement of the sheet conveying device according to the present embodiment of this disclosure.
Figure 13B:
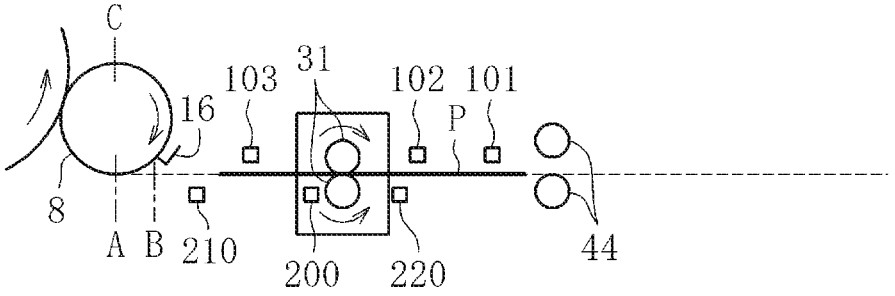
FIG. 13B is a side view illustrating the movement of the sheet conveying device of FIG. 13A.

Further, as illustrated in FIGS. 13A and 13B, when the leading end portion Pb of the sheet P reaches the third CIS 103, a "second position detection" in which the second CIS 102 and the third CIS 103 detect the position of the side edge Pa of the sheet P for the second time is performed (step S6 in the flowchart of FIG. 16). Based on the position information detected by the second CIS 102 and the third CIS 103, the angular and lateral displacement amounts of the sheet P are calculated by the positional deviation amount calculator 21. Then, based on the calculated angular and lateral displacement amounts of the sheet P, the lateral drive motor 62 is controlled to move the pair of sheet holding rollers 31 in the width direction (i.e., in a direction indicated by arrow S3 or in a direction indicated by arrow S4 in FIG. 13A and the angular drive motor 63 is controlled to rotate the pair of sheet holding rollers 31 within a plane of sheet conveyance (i.e., in a direction indicated by arrow W3 or in a direction indicated by arrow W4 in FIG. 13A. By so doing, a "secondary correction" in which the angular and lateral displacements of the sheet P are corrected is performed (step S7 in the flowchart of FIG. 16).

As described above, by detecting the angular and lateral displacements of the sheet P (i.e., the second position detection) even after the adjustment operation (i.e., the primary correction) and correcting the angular and lateral displacements of the sheet P based on the detection results (i.e., the secondary correction), the angular and lateral displacements of the sheet P that are generated while the sheet P is being conveyed by the pair of sheet holding rollers 31 is eliminated. Further, detection of the angular and lateral displacements of the sheet P after completion of the adjustment operation (i.e., the second position detection) may be performed multiple times at predetermined intervals during a period that the sheet P is passing by the second CIS 102 and the third CIS 103. Therefore, by performing the detection of the angular and lateral displacements of a sheet (i.e., the second position detection) for multiple times and performing the correction of the angular and lateral displacements (i.e., the secondary correction) each time the above-described detection is performed, the sheet is conveyed with higher accuracy.

However, when the above-described correction of the angular and lateral displacements of the sheet (i.e., the secondary correction) is performed, the position of the sheet in the sheet conveying direction changes. Therefore, in a case in which the sheet having the change of the position in the sheet conveying direction is conveyed at the same conveying speed, the timing of arrival of the sheet to the target position B also changes. Therefore, in the present embodiment, when a positional deviation correction (second correction) is performed after the adjustment operation, the conveying speed of the sheet P is changed (corrected) (step S8 in the flowchart of FIG. 16). Further, as illustrated in FIGS. 14A and 14B, when the second leading end detection sensor 210 detects the leading end portion Pb of the sheet P (i.e., a "second timing detection"), apart from the above-described correction of the conveying speed of the sheet P, the target conveyance timing of the sheet P to the predetermined target position B is set again (reset) to be updated based on the detection result of the second leading end detection sensor 210 and the detection result of the rotary encoder 17 to detect the conveyance rotation of the transfer cylinder 8. After the target conveyance timing of the sheet P is set again (reset), the conveying speed of the sheet P is changed in synchronization with the target conveyance timing of the sheet P that is set again (reset) and updated. Then, as the sheet P is further conveyed to the downstream side in the sheet conveying direction at the conveying speed changed as described above, the sheet P is conveyed to the sheet gripping position A at the same timing the gripper 16 reaches the sheet gripping position A, as illustrated in FIGS. 15A and 15B (step S9 in the flowchart of FIG. 16). Consequently, at the moment the sheet P reaches the sheet gripping position A, the rollers of the pair of sheet holding rollers 31 are separated from each other, and the conveyance of the sheet P by the pair of sheet holding rollers 31 is completed. It is to be noted that, in a case in which no angular and lateral displacements of the sheet P are generated after completion of the adjustment operation and therefore the correction of the angular and lateral displacements of the sheet P (i.e., the secondary correction) has not been performed, the timing of arrival of the sheet P to the target position B does not change basically. Accordingly, no change is performed to the conveying speed of the sheet P corresponding to the correction of angular and lateral displacements of the sheet P (i.e., the secondary correction).

Hereinafter, a description is given of a method of controlling the conveying speed of a sheet with reference to a flowchart of FIG. 17.

Figure 17:
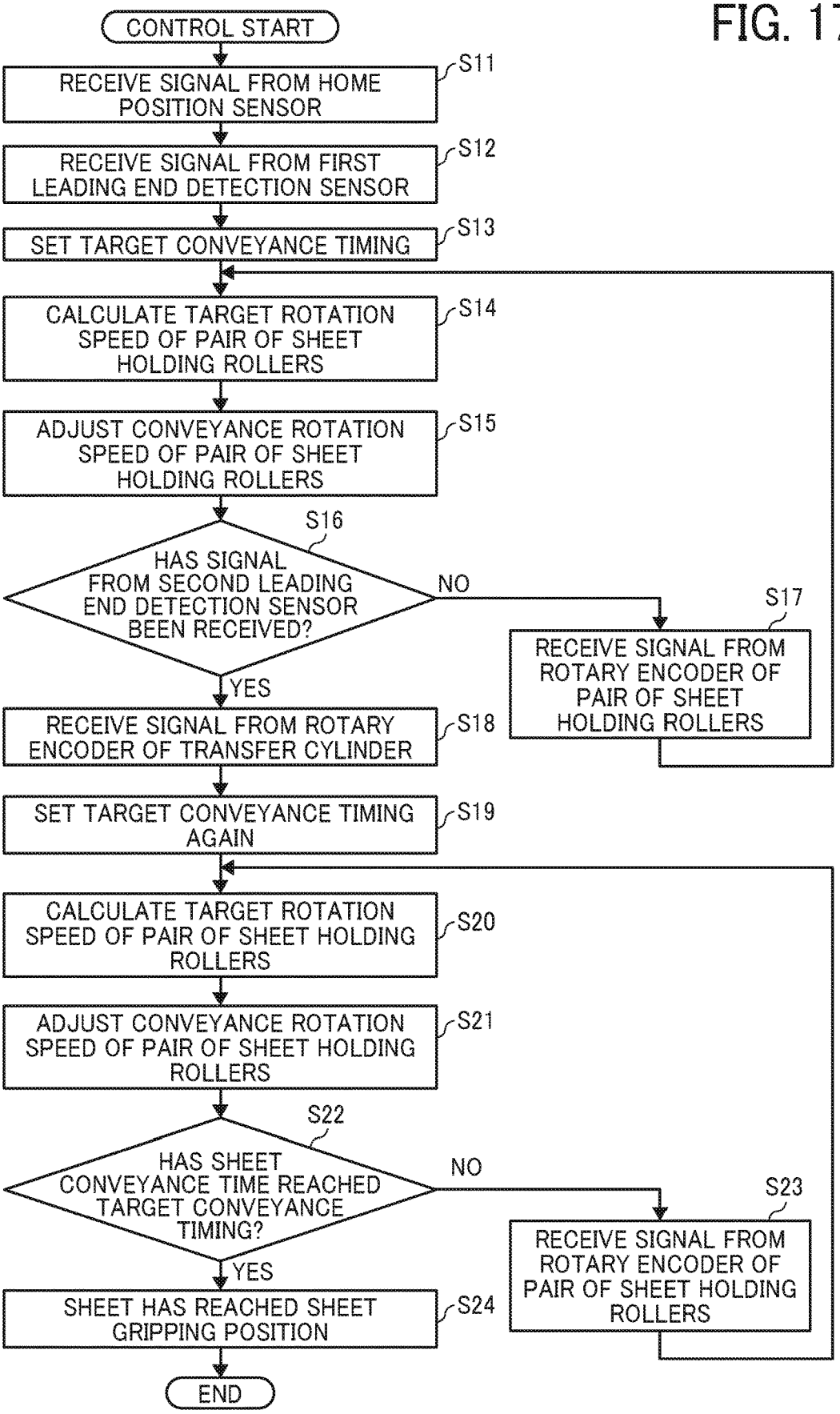
FIG. 17 is a flowchart of a method of controlling a sheet conveying speed.

As illustrated in FIG. 17, when the control of the pair of sheet holding rollers 31 is started, it is confirmed that the gripper 16 is located at the rotation reference position C, based on the detection result of the home position sensor 80 of the transfer cylinder 8 before the target conveyance timing is set (step S11 of the flowchart in FIG. 17). Then, as described above, the first leading end detection sensor 200 detects the leading end of the sheet (step S12 in the flowchart of FIG. 17). Then, the target conveyance timing is set based on the detection result of the first leading end detection sensor 200 and the detection result of the home position sensor 80 of the transfer cylinder 8 (step S13 in the flowchart of FIG. 17).

Thereafter, the target rotation speed of the pair of sheet holding rollers 31 is calculated in accordance with the set target conveyance timing (step S14 in the flowchart of FIG. 17). It is to be noted that the calculation of the target rotation speed of the pair of sheet holding rollers 31 may be performed by the target conveyance timing calculator 22 or any other calculator. Then, based on the calculated target rotation speed of the pair of sheet holding rollers 31, the conveyance rotation speed of the pair of sheet holding rollers 31 is controlled (step S15 in the flowchart of FIG. 17). After step S15, it is determined whether or not the second leading end detection sensor 210 detects the leading end of the sheet P and the signal from the second leading end detection sensor 210 is received (step S16 in the flowchart of FIG. 17).

In the present embodiment, the conveyance rotation speed of the pair of sheet holding rollers 31 is managed based on a signal from the rotary encoder 96 mounted on the pair of sheet holding rollers 31. Accordingly, in order to determine whether the conveyance rotation speed of the pair of sheet holding rollers 31 is faster or slower than the target rotation speed of the pair of sheet holding rollers 31, the conveying speed controller 23 that functions as circuitry obtains the signal from the rotary encoder 96 (step S17 in the flowchart of FIG. 17).

Then, the target rotation speed of the pair of sheet holding rollers 31 is calculated in accordance with the set target conveyance timing of the pair of sheet holding rollers 31 (step S14 in the flowchart of FIG. 17). Then, based on the calculated target rotation speed of the pair of sheet holding rollers 31, the conveyance rotation speed of the pair of sheet holding rollers 31 is controlled (step S15 in the flowchart of FIG. 17). Thereafter, it is determined whether or not the second leading end detection sensor 210 detects the leading end of the sheet P and the signal from the second leading end detection sensor 210 is received (step S16 in the flowchart of FIG. 17). When the second leading end detection sensor 210 has not detected the leading end of the sheet P and the signal from the second leading end detection sensor 210 has not been received (NO in step S16 in the flowchart of FIG. 17), the signal from the rotary encoder 96 of the pair of sheet holding rollers 31 is received (step S17 in the flowchart of FIG. 17) and the above-described adjustment (control) of the conveyance rotation speed of the pair of sheet holding rollers 31 is repeated until the leading end of the sheet P reaches the second leading end detection sensor 210.

When the second leading end detection sensor 210 has detected the leading end of the sheet P and the signal from the second leading end detection sensor 210 has been received (YES in step S16 in the flowchart of FIG. 17), the target conveyance timing of the sheet P is set again (updated) based on the signal from the rotary encoder 17 of the transfer cylinder 8 (step S18 in the flowchart of FIG. 17) and the signal from the second leading end detection sensor 210 (step S19 in the flowchart of FIG. 17). Then, the target rotation speed of the pair of sheet holding rollers 31 is calculated again (updated) (step S20 in the flowchart of FIG. 17), and the conveyance rotation speed of the pair of sheet holding rollers 31 is adjusted based on the calculate (updated) target rotation speed of the pair of sheet holding rollers 31 (step S21 in the flowchart of FIG. 17).

After step S21, it is determined whether or not the sheet conveyance time has reached the target conveyance timing of the sheet P (step S22 in the flowchart of FIG. 17). When the sheet conveyance time has not reached the target conveyance timing of the sheet P (NO in step S22 in the flowchart of FIG. 17), similar to the above-described adjustment (control) in step S16, the signal from the rotary encoder 96 of the pair of sheet holding rollers 31 is received (step S23 in the flowchart of FIG. 17) and the above-described adjustment (control) of the sheet conveyance time of the sheet P is repeated until the sheet conveyance time has reached the target conveyance timing of the sheet P.

When the sheet conveyance time has reached the target conveyance timing of the sheet P (YES in step S22 in the flowchart of FIG. 17), the process proceeds to step S24.

Here, the main factor to change the conveyance rotation speed of the pair of sheet holding rollers 31 is thought to be the change of the sheet conveyance timing caused by the correction of angular and lateral displacements after the above-described adjustment operation (i.e., the secondary correction). Further, as a factor to set the target conveyance timing of the sheet P is set again (updated), there are many other factors such as deviation of the sheet conveyance timing caused by slippage between the sheet and the pair of sheet holding rollers 31. With any factors, by setting repeatedly (updating) the conveyance rotation speed of the pair of sheet holding rollers 31 based on the sheet conveyance timing of the sheet detected by the second leading end detection sensor 210, the sheet can be conveyed to the sheet gripping position A timely and highly accurately (step S24 in the flowchart of FIG. 17).

Figure 18:
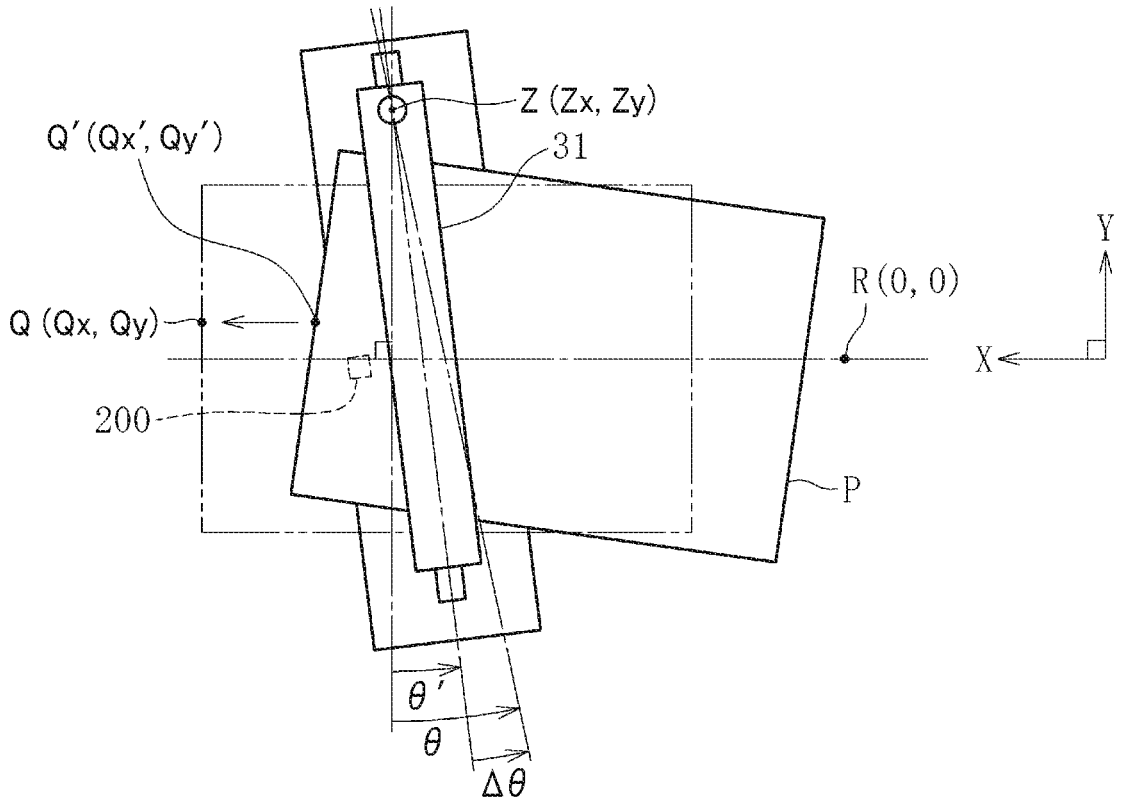
FIG. 18 is a diagram for explaining a method of calculating an amount of position change of a sheet according to correction of angular and lateral displacements.

Now, a description is given of a method of calculating the amount of position change of a sheet according to correction of the angular and lateral displacements of the sheet with reference to FIG. 18.

FIG. 18 is a diagram for explaining a method of calculating the amount of position change of a sheet according to correction of angular and lateral displacements of the sheet.

In FIG. 18, a point Z indicates a position of the rotation center (i.e., the support shaft 73) within a plane of sheet conveyance when the pair of sheet holding rollers 31 is located at the home position, a point R indicates a measurement reference point, a point Q indicates a position of the leading end of the sheet when a time t has elapsed after the first leading end detection sensor 200 has detected the leading end of the sheet, and a point Q' indicates a position of the leading end of the sheet when the angular and lateral displacements of the sheet is corrected at a timing (i.e., a time t−1) which is one previous timing before the time t. Further, in FIG. 18, letters in parentheses indicate are respective X coordinates and Y coordinates of the points Z, Q and Q' relative to the point R that functions as the measurement reference point, where the sheet conveying direction is an X direction and a direction perpendicular to the sheet conveying direction is a Y direction. Further, "θ" indicates an angle of inclination (positional deviation) of the pair of sheet holding rollers 31 from the home position (i.e., an angle of rotation within a plane of sheet conveyance of the sheet) when the leading end of the sheet reaches the position of the point Q, and "θ'" indicates an angle of inclination (positional deviation) of the pair of sheet holding rollers 31 from the home position (i.e., an angle of rotation of the pair of sheet holding rollers 31 within a plane of sheet conveyance) when the leading end of the sheet reaches the position of the point Q'. "Δθ" indicates the difference between the angle of inclination θ and the angle of inclination θ'.

As described above, in a case in which the position of the leading end of the sheet P changes along with the correction of angular and lateral displacements of the sheet P, the position coordinates (Qx, Qy) of a leading end position Q at the time t are calculated using the following equations, which are Equation 1 and Equation 2).

$$Qx=\cos(\Delta\theta)(Qx'-Zx)-\sin(\Delta\theta)(Qy'-Zy)+Zx+Xp \quad \text{Equation 1.}$$

$$Qy=\sin(\Delta\theta)(Qx'-Zx)+\cos(\Delta\theta)(Qy'-Zy)+Zy+Yp+Yx \quad \text{Equation 2.}$$

"Xp" in Equation 1 is an X direction component of a conveyance distance of the sheet P in which the sheet P is conveyed until the one previous timing (i.e., the time t−1) before the time t. "Yp" in Equation 2 is a Y direction component of the conveyance distance of the sheet P. When a conveyance distance of the sheet P in which the sheet P is conveyed by the pair of sheet holding rollers 31 until the time t−1 (that is, a conveyance distance of the sheet P in a direction perpendicular to the roller shaft) is indicated as "Fp", Xp and Yp are expressed by the following Equations 3 and 4. Further, "Ys" in Equation 2 is an amount of movement of the sheet P in the width direction from the point Q' to the point Q (i.e., an amount of movement in a Y direction).

$$Xp=\cos(\theta')Fp \quad \text{Equation 3.}$$

$$Yp=\sin(\theta')Fp \quad \text{Equation 4.}$$

Therefore, by using the above Equations 1 to 4, the position coordinates (Qx, Qy) of the leading position Q at the time t is calculated.

Then, by subtracting an X coordinate Vx of the sheet leading end position after the time t has elapsed without the correction of the angular and lateral displacements of the sheet, from the calculated X coordinate Qx, the position change amount G of the leading end of the sheet according to the correction of the angular and lateral displacements of the sheet is calculated (see Equation 5 below). Then, by adjusting the conveying speed of the sheet to the target position based on the position change amount G that is calculated as described above, the sheet is conveyed to the target position at a predetermined sheet conveyance timing.

$$G=Qx-Vx \qquad \text{Equation 5.}$$

As described above, in the sheet conveying device according to the present embodiment of this disclosure, the first leading end detection sensor 200 is driven (integrally) together with the pair of sheet holding rollers 31. Therefore, even when the pair of sheet holding rollers 31 is driven in the width direction or in the rotational direction within a plane of sheet conveyance in order to perform the angular and lateral displacement correction (i.e., the primary correction), the first leading end detection sensor 200 moves following the movement of the sheet. Therefore, the relation of relative positions of the first leading end detection sensor 200 and the sheet does not change. Accordingly, the variation in the sheet conveyance timing due to the change of the relation of relative positions of the first leading end detection sensor 200 and the sheet is eliminated.

Further, in the present embodiment, in addition to that there is no relative positional change between a sensor and a sheet along with the correcting operation of the positional deviation, no deviation of the leading end detection position is generated when the sheet has an angular deviation and the target conveyance timing is not susceptible to the movement of the sensor. That is, the pair of sheet holding rollers 31 performs the pick up operation before holding the sheet in the present embodiment. At this time, the first leading end detection sensor 200 is driven together with the pair of sheet holding rollers 31. Therefore, the first leading end detection sensor 200 can detect the sheet each time in a state in which the first leading end detection sensor 200 is disposed facing the sheet in the normal position (in other words, each time at the same position). Consequently, the leading end detection position of the first leading end detection sensor 200 may not vary according to the degree of angular displacement of the sheet. Therefore, the target conveyance timing may not be susceptible to the variation in the leading end detection position. In addition, the first leading end detection sensor 200 is returned to the same position (i.e., the home position) each time along with the adjustment operation performed by the pair of sheet holding rollers 31. Therefore, the distance from the first leading end detection sensor 200 to the target position B is the same distance each time. Accordingly, the target conveyance timing of the sheet is not susceptible to the change in the distance from the first leading end detection sensor 200 to the target position B.

As described above, in the present embodiment, the first leading end detection sensor 200 is driven together with the pair of sheet holding rollers 31. Therefore, there is no various adverse effects that are generated when the sensors are fixed, and therefore the conveying speed of the sheet according to the correcting operation of the positional deviation of the sheet (i.e., the primary correction) may not be changed. Further, since the target conveyance timing is not affected by the correcting operation of the positional deviation of the sheet, the sheet conveyance timing of the sheet is detected before completion of the adjustment operation (in other words, before or during the adjustment operation). Therefore, the target conveyance timing can be set at an early stage, and sufficient control time of the conveying speed of the sheet to be performed later can be secured, and the accuracy in control is enhanced. As a result, the positional deviation of the image to the sheet P is prevented with high accuracy, and therefore the print quality is enhanced. Further, when performing the duplex printing operation, the positional deviation of images to the front side and the rear side is corrected, and therefore a relative positional deviation of the image formed on the front face of the sheet P and the image formed on the back face of the sheet P is eliminated.

It is to be noted that, in the present embodiment, the first leading end detection sensor 200 is disposed on the downstream side of the pair of sheet holding rollers 31. However, in order to obtain the effect by driving the first leading end detection sensor 200 together with the pair of sheet holding rollers 31, the first leading end detection sensor 200 may be disposed upstream from the pair of sheet holding rollers 31 in the sheet conveying direction.

Further, according to the present embodiment, the conveying speed of the sheet along with the adjustment operation (i.e., the primary correction) may not need to be changed. Therefore, the conveying speed of the sheet may be changed corresponding to the correction of angular and lateral displacements of the sheet after the adjustment operation (i.e., the secondary correction). Moreover, the correction of angular and lateral displacements of the sheet after the adjustment operation (i.e., the secondary correction) is a fine correction of the displacements of the sheet to be performed after the angular and lateral displacements of the sheet have corrected once. Therefore, the change of the conveying speed of the sheet along with the correction of the displacements of the sheet (i.e., the secondary correction) is generally sufficient to be a fine change. Accordingly, even when the sheet is conveyed at high speed or even when the distance of conveyance of the sheet to the target position is short, the conveying speed of the sheet can be changed sufficiently.

Furthermore, in the present embodiment, since the second leading end detection sensor 210 is disposed downstream from the first leading end detection sensor 200 in the sheet conveying direction, even when the correction of the angular and lateral displacements after the adjustment operation (i.e., the second correction) is performed, the deviation of the sheet conveyance timing along with this correction of the angular and lateral displacements can be eliminated. Further, it is desirable that the leading end position of the sheet is detected by the second leading end detection sensor 210 when the pair of sheet holding rollers 31 in the correcting operation of the angular and lateral displacements (i.e., the secondary correction) has completed the rotation within a plane of sheet conveyance rotation of the sheet. By detecting the position of the leading end of the sheet at this timing, the correcting operation of the angular and lateral displacements is no longer performed. Therefore, the sheet conveyance timing of the sheet is controlled more reliably. It is to be noted that a sheet conveying device that does not perform the correcting operation of the angular and lateral displacements (i.e., the secondary correction) after the adjustment operation may do without the second leading end detection sensor 210.

Figure 19:
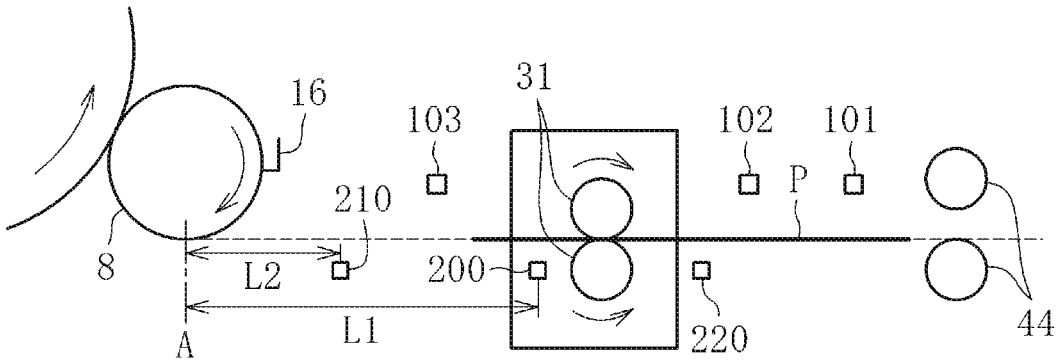
FIG. 19 is a diagram illustrating a distance from a first leading end detection sensor to a sheet gripping position and a distance from a second leading end detection sensor to the sheet gripping position.

Further, in the present embodiment, in order to convey a sheet accurately without being affected by variation in diameter of the pair of sheet holding rollers 31, as illustrated in FIG. 19, a distance L1 from the first leading end detection sensor 200 to the sheet gripping position A that corresponds to the final target conveyance position is set to be integral multiples of the roller circumference of the pair of sheet holding rollers 31. That is, in a case in which the diameter of the pair of sheet holding rollers 31 has variations over the circumferential direction thereof, a region having a fast linear velocity and a region having a slow linear velocity are generated while the pair of sheet holding rollers 31 rotates for one cycle. However, by setting the distance L1 to be integral multiples of the roller circumference of the pair of sheet holding rollers 31, the region having a fast linear velocity and the region having a slow linear velocity act at the same rate each time. Therefore, the stop position of the sheet P to the sheet gripping position A no longer varies. In addition, for the same reason, a distance L2 from the second leading end detection sensor 210 to the sheet gripping position A is also set to be an integral multiple of the roller circumference of the pair of sheet holding rollers 31.

Figure 20:
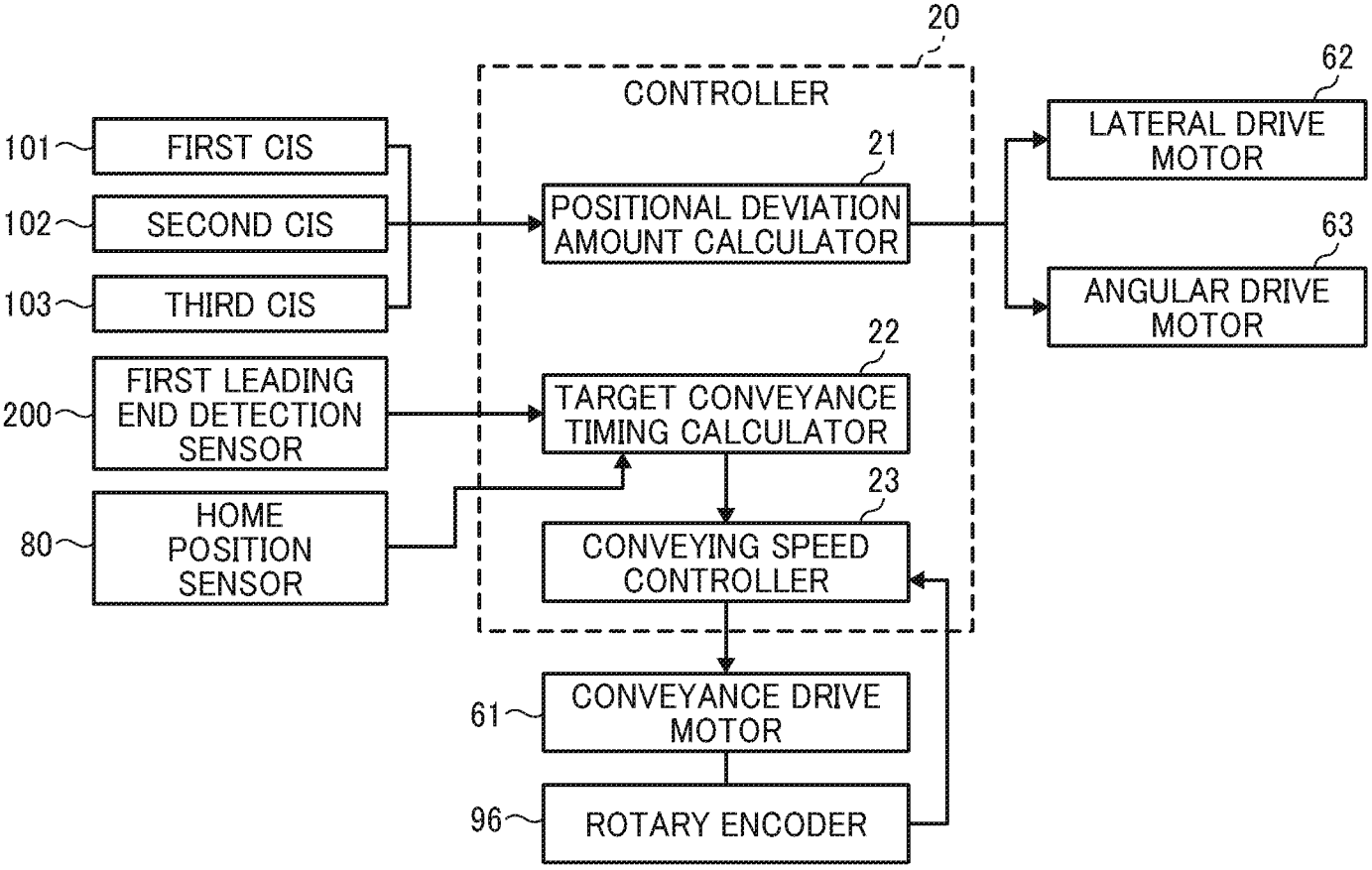
FIG. 20 is a block diagram illustrating a control system of a sheet conveying device according another embodiment of this disclosure.
Figure 21:
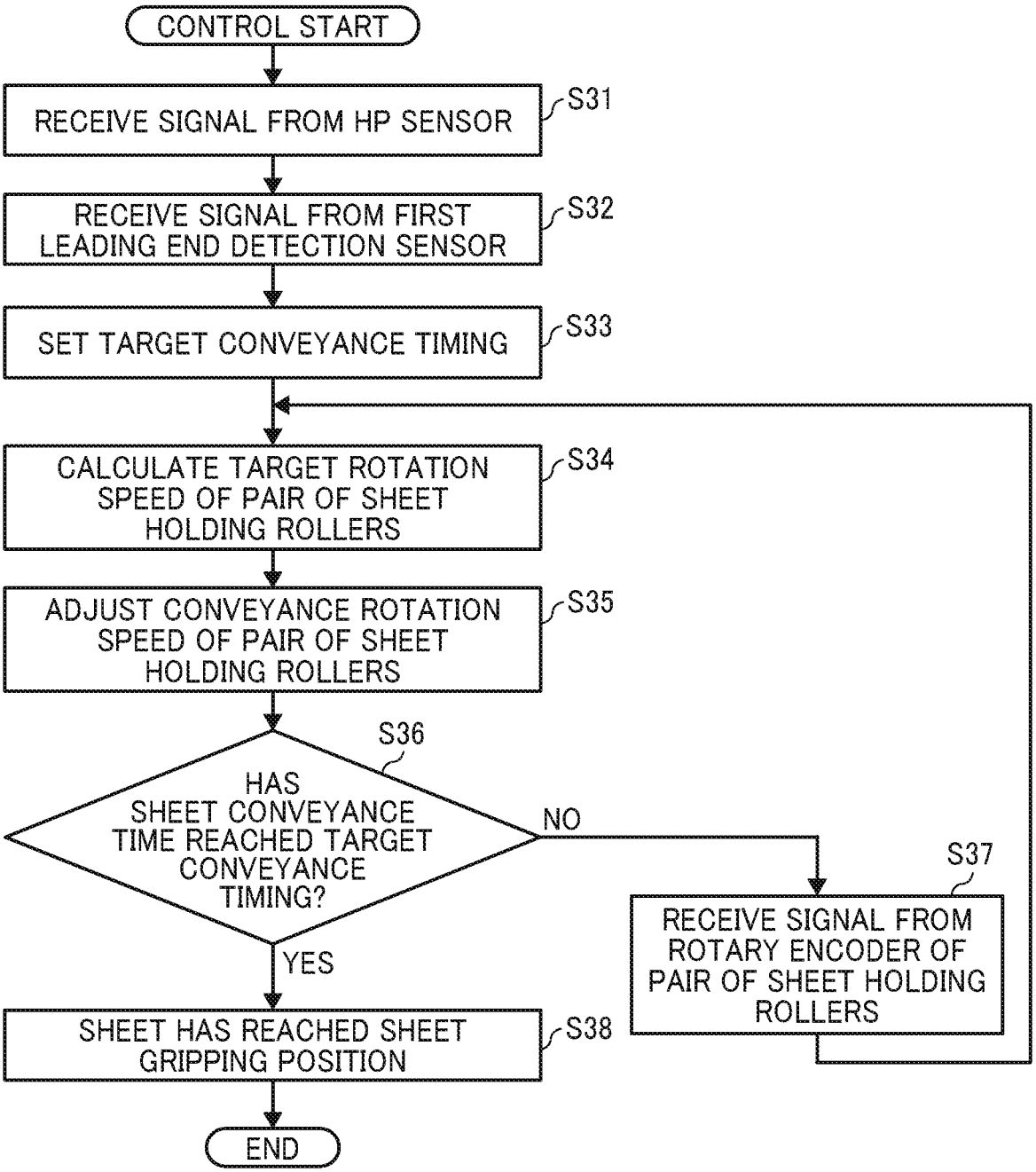
FIG. 21 is a flowchart of the sheet conveying device according to another embodiment of this disclosure.

Now, a description is given of the sheet conveying device 7 according to another embodiment of this disclosure with reference to FIGS. 20 and 21.

FIG. 20 is a block diagram illustrating a control system of the sheet conveying device 7 according another embodiment of this disclosure. FIG. 21 is a flowchart of the sheet conveying device 7 according to another embodiment of this disclosure.

The sheet conveying device 7 according to another embodiment illustrated in FIG. 20 basically has a configuration identical to the sheet conveying device 7 illustrated in FIG. 6. However, different from the sheet conveying device 7 illustrated in FIG. 6, the target conveyance timing calculator 22 in the sheet conveying device 7 illustrated in FIG. 20 does not receive a signal from the second leading end detection sensor 201 and a signal from the rotary encoder 17 of the transfer cylinder 8. In other words, the target conveyance timing calculator 22 receives a signal from the first leading end detection sensor 200 and a signal from the home position sensor 80 of the transfer cylinder 8. According to this configuration, in the flowchart of FIG. 21, the process in which a signal from the second leading end detection sensor 210 is received (i.e., step S16 in the flowchart of FIG. 17), the process in which a signal from the rotary encoder 17 of the transfer cylinder 8 is received (i.e., step S18 in the flowchart of FIG. 17), the process in which the target conveyance timing of the sheet P is set again (i.e., step S19 in the flowchart of FIG. 17), and the processes related to the adjustment of the conveyance rotation speed of the pair of sheet holding rollers 31 (i.e., steps S20, 21, and 23) are omitted. In other words, in this case, the processes until the sheet conveyance time reaches the target conveyance timing of the sheet P (i.e., YES in step S16), that is, the first half processes (i.e., steps S11 through 17) in the flowchart of FIG. 17 are performed. Specifically, steps S31 through S37 in the flowchart of FIG. 21 perform the same processes as steps S11 through S17 in the flowchart of FIG. 17 and step S38 in the flowchart of FIG. 21 performs the same process as step S24 in the flowchart of FIG. 17. Accordingly, the process related to the second leading end detection sensor 210 and the process to set the target conveyance timing of the sheet P based on the detection result (i.e., the signal) of the second leading end detection sensor 210 may be omitted.

Figure 22:
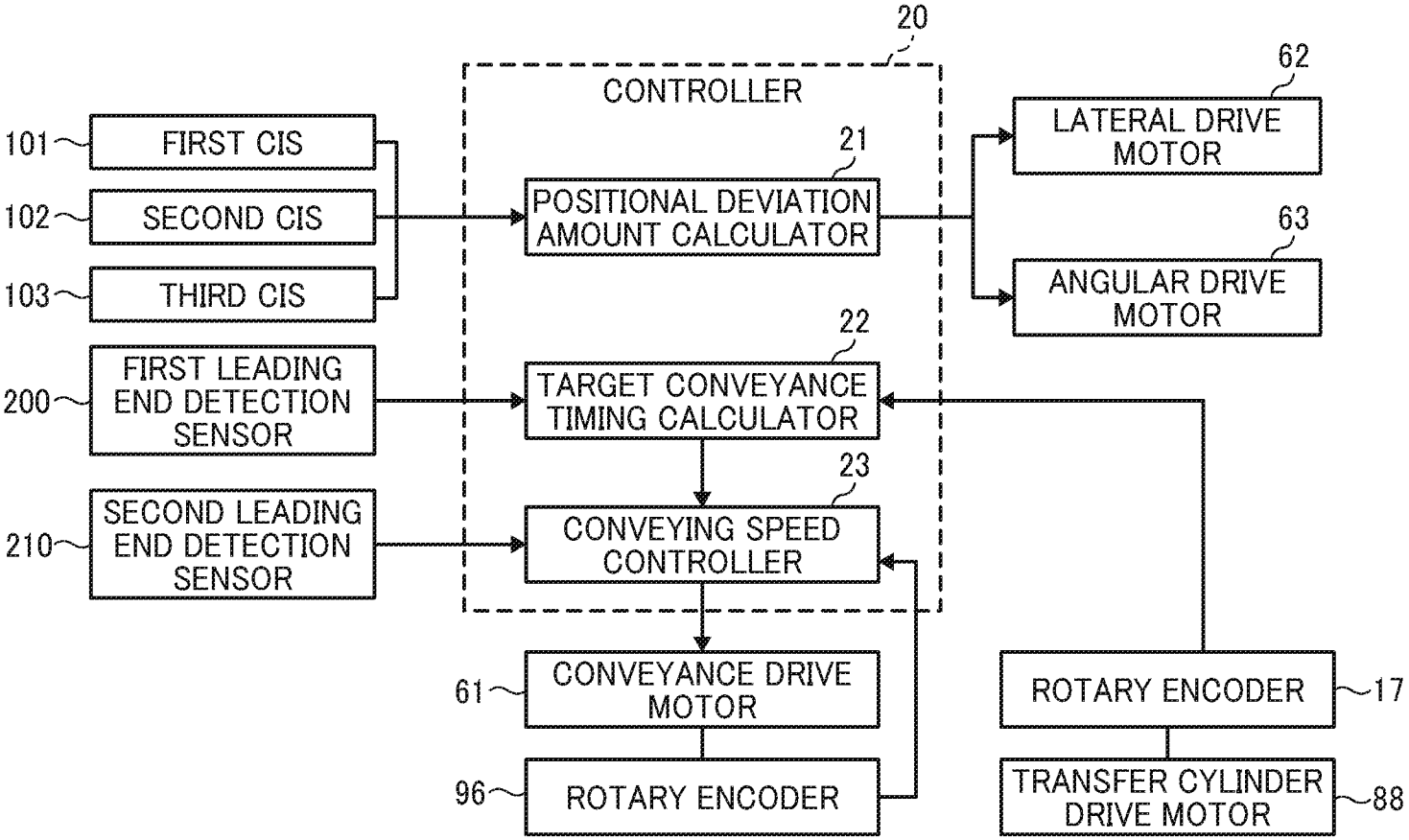
FIG. 22 is a block diagram illustrating a control system of a sheet conveying device according yet another embodiment of this disclosure.

Next, a description is given of the sheet conveying device 7 according to yet another embodiment of this disclosure with reference to FIGS. 22 and 23.

Figure 23A:
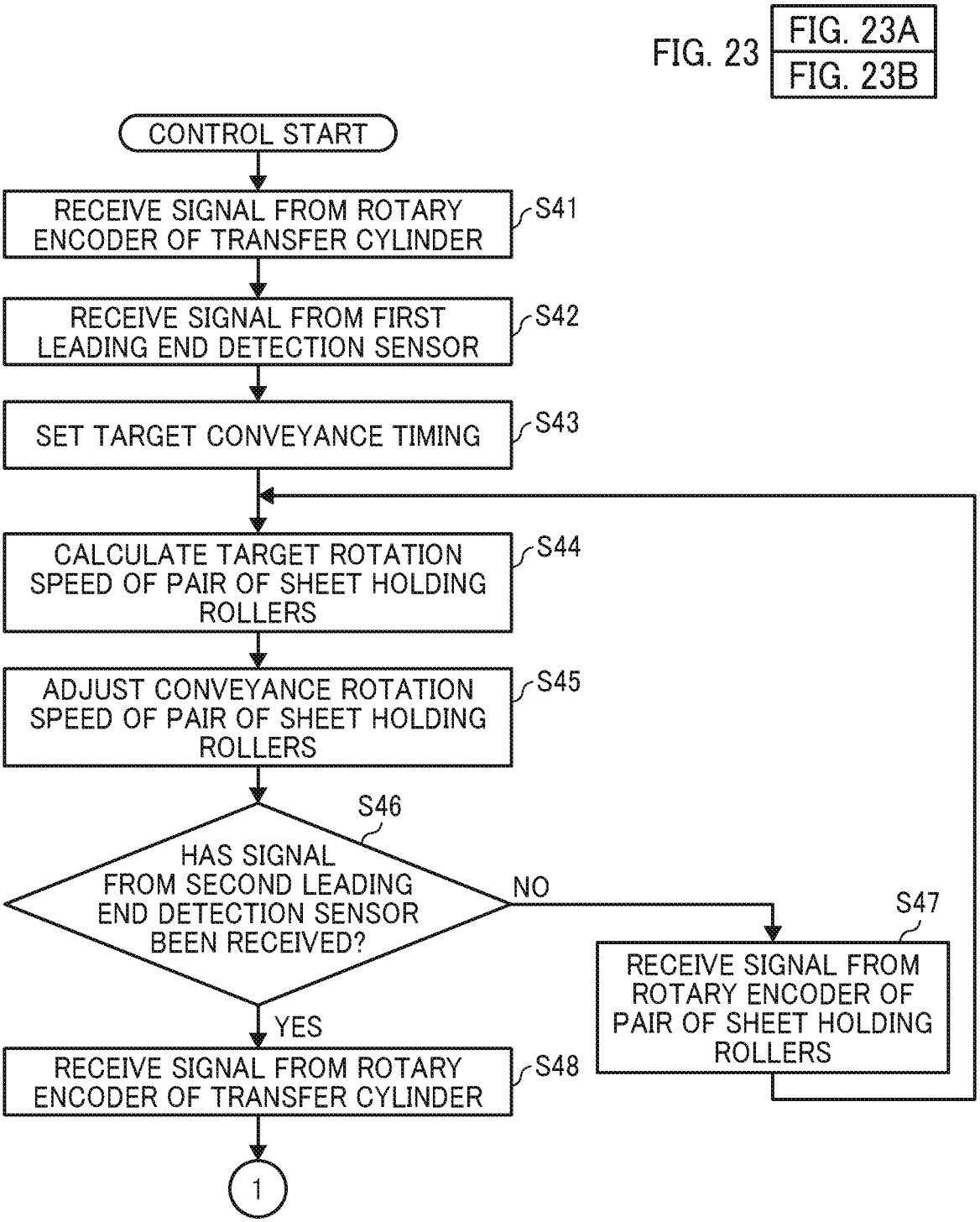
FIG. 23 includes FIGS. 23A and 23B illustrating a flowchart of the sheet conveying device according to yet another embodiment of this disclosure.
Figure 23B:
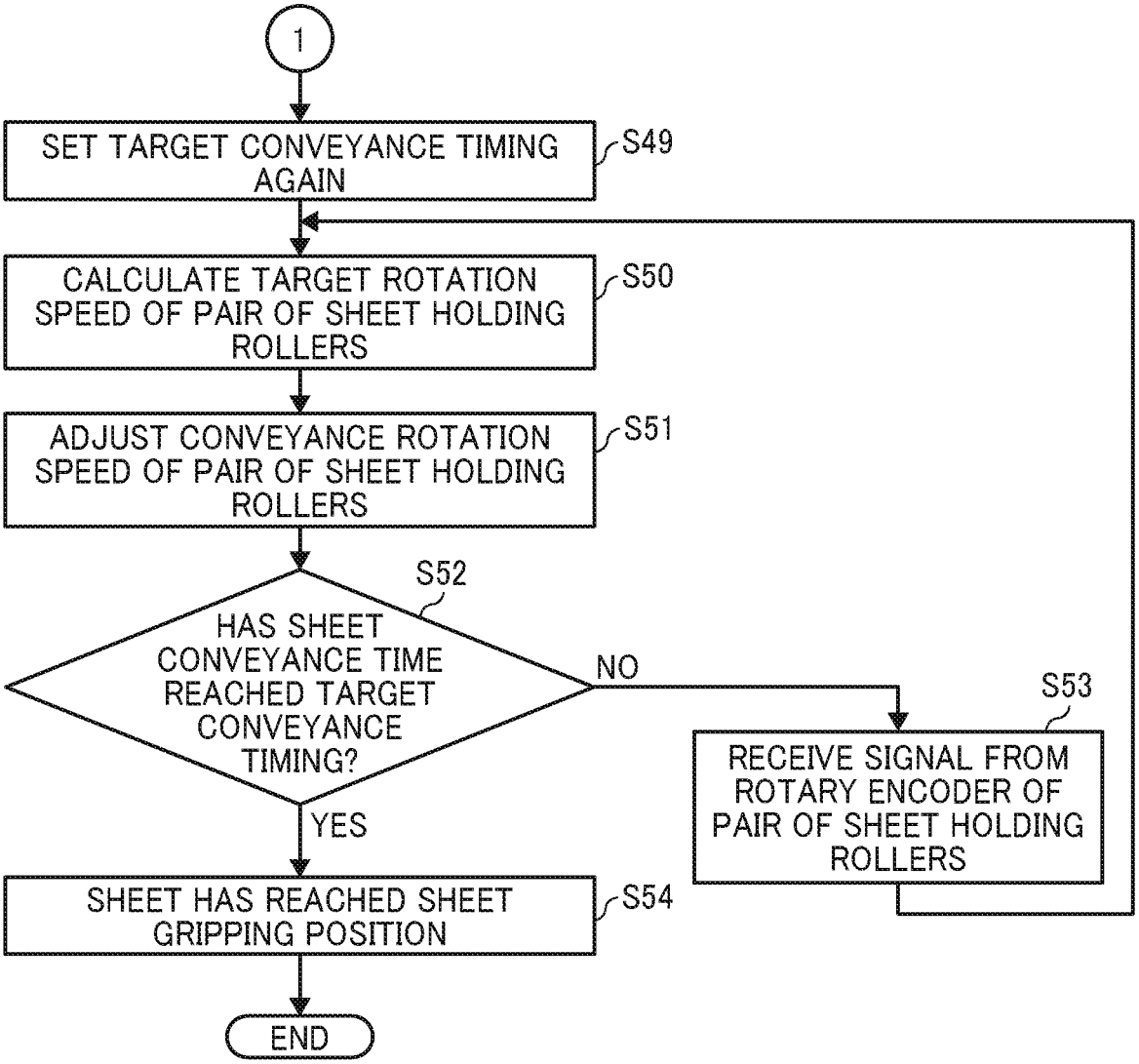

FIG. 22 is a block diagram illustrating a control system of the sheet conveying device 7 according yet another embodiment of this disclosure. FIG. 23 includes FIGS. 23A and 23B illustrating a flowchart of the sheet conveying device 7 according to yet another embodiment of this disclosure.

The sheet conveying device 7 according to yet another embodiment illustrated in FIG. 22 basically has a configuration identical to the sheet conveying device 7 illustrated in FIG. 6, except the sheet conveying device 7 in FIG. 22 does not include the home position sensor 80. Specifically, different from the sheet conveying device 7 illustrated in FIG. 20, the sheet conveying device 7 illustrated in FIG. 22 receives the signal from the rotary encoder 17 of the transfer cylinder 8 driven by the transfer cylinder drive motor 88 (see step S41 in the flowchart of FIG. 23A) instead of the signal from the home position sensor 80 (i.e., step S11 in the flowchart of FIG. 17). That is, without receiving a signal from the home position sensor 80, the position of the gripper 16 is confirmed based on the signal from the rotary encoder 17 of the transfer cylinder 8. Accordingly, in the present embodiment, based on the signal from the rotary encoder 17 of the transfer cylinder 8 is received (step S41 in the flowchart of FIG. 23A) and the signal from the first leading end detection sensor 200 is received (step S42 in the flowchart of FIG. 23A), the target conveyance timing of the sheet P is set (step S43 in the flowchart of FIG. 23A). Apart from the difference, the configuration of the sheet conveying device 7 illustrated in FIG. 22 and the other processes (i.e., steps S42 through 54) in the flowchart of FIG. 23 including FIGS. 23A and 23B are same as the configuration of the sheet conveying device 7 illustrated in FIG. 16 and the processes (i.e., steps S12 through 24) in the flowchart of FIG. 17, respectively.

Figure 24:
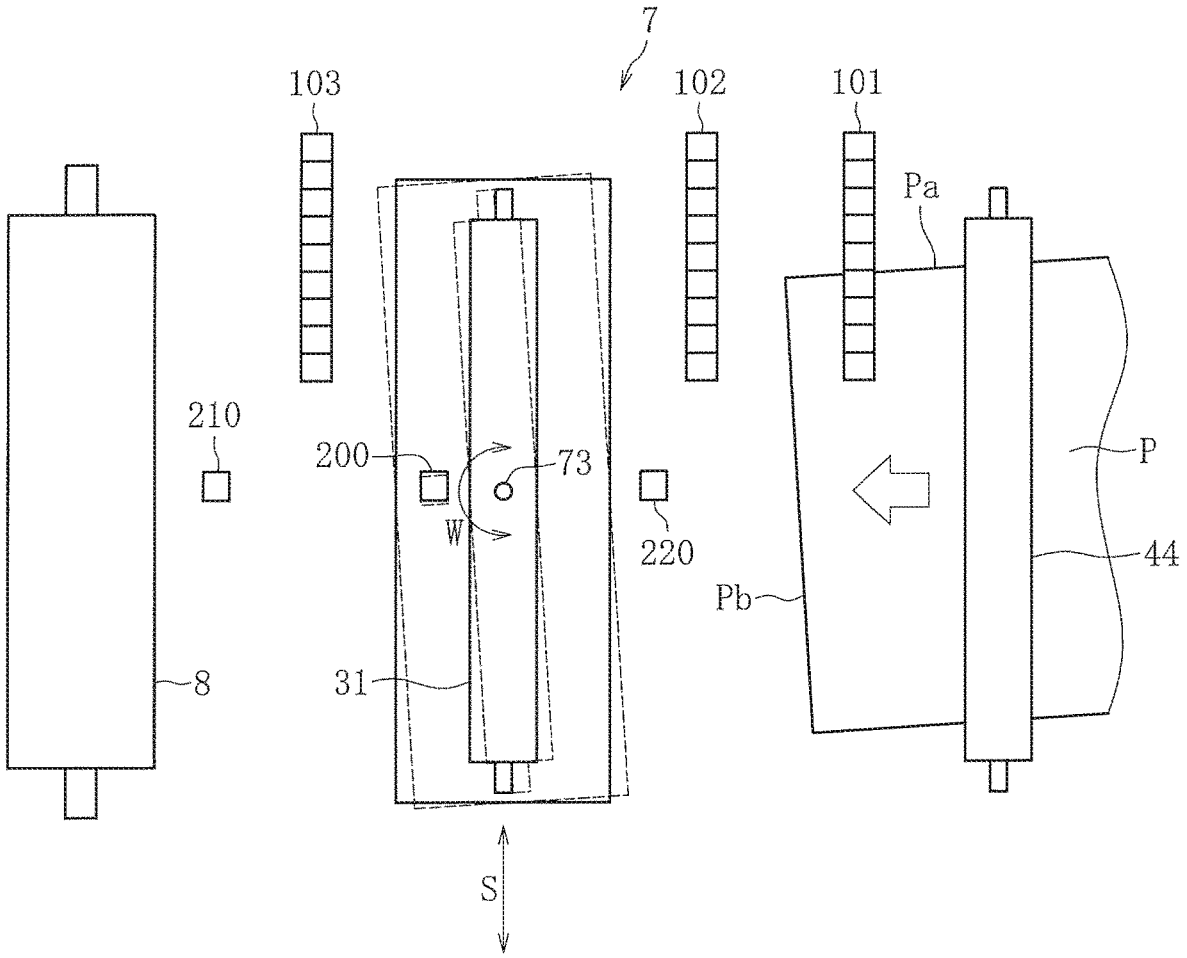
FIG. 24 is a diagram illustrating both a first leading end detection sensor and a support shaft are mounted at an axial center position of the pair of sheet holding rollers.
Figure 25:
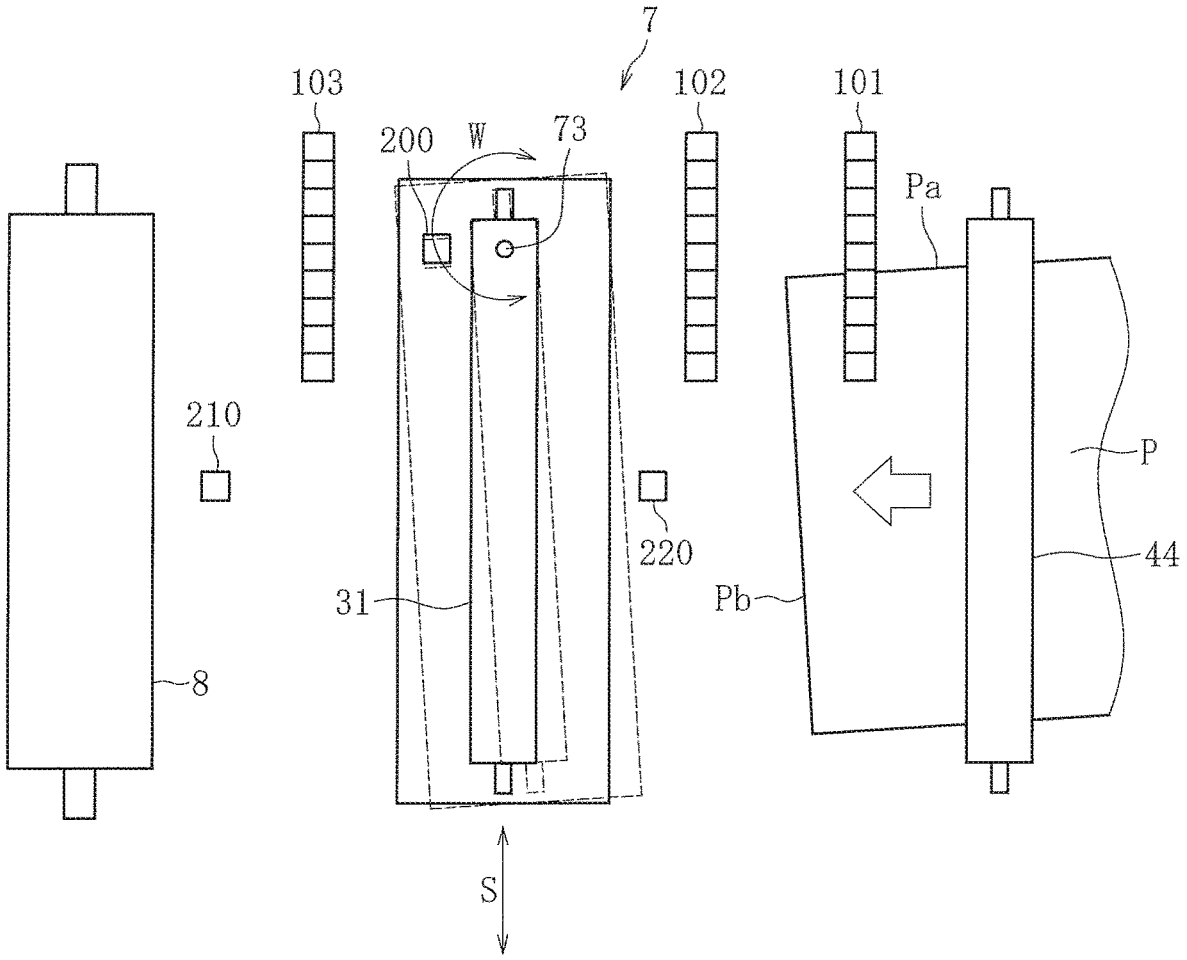
FIG. 25 is a diagram illustrating both a first leading end detection sensor and a support shaft are mounted on the same one end side in the axial direction of the pair of sheet holding rollers.

Further, in the above-described embodiments, the first leading end detection sensor 200 is mounted at an axial center of the pair of sheet holding rollers 31 and the support shaft 73 is mounted on one end side in the axial direction of the pair of sheet holding rollers 31, as illustrated in FIG. 2. However, the positions of the first leading end detection sensor 200 and the support shaft 73 are not limited thereto. For example, as illustrated in FIG. 24, both the first leading end detection sensor 200 and the support shaft 73 may be mounted at the axial center of the pair of sheet holding rollers 31. Alternatively, as illustrated in FIG. 25, both the first leading end detection sensor 200 and the support shaft 73 may be mounted on the same one end side in the axial direction of the pair of sheet holding rollers 31. In a case in which the first leading end detection sensor 200 and the support shaft 73 are disposed at positions close to each other, as illustrated in FIGS. 24 and 25, even when an angular displacement is generated to the sheet P, an adverse effect of the positional deviation (i.e., the angular displacement) of the sheet P is reduced.

Although the embodiments of this disclosure have been described above, this disclosure is not limited to the above-described embodiments, and it is obvious that various modifications can be made without departing from the gist of this disclosure.

In the above-described embodiments, CISs are used as position detectors to detect the position of the side end of a sheet. However, the position detector is not limited to a CIS and may be any detector such as multiple photosensors disposed along the width direction of the sheet as long as the detector detects the side edge of a sheet.

Further, in the above-described embodiments, both the angular displacement of a sheet and the lateral displacement of the sheet are corrected. However, the sheet conveying device according to this disclosure may also be applied when correcting either one of the angular displacement of a sheet and the lateral displacement of the sheet.

Further, in the above-described embodiments, the conveying speed of a sheet is adjusted by changing the conveyance rotation speed of the pair of sheet holding rollers 31. However, without changing the conveying rotational speed of the pair of sheet holding rollers 31, a pair of sheet conveying rollers may be added to adjust the conveying speed of the sheet on the downstream side of the pair of sheet holding rollers 31.

Further, in the above-described embodiments, the sheet conveying device according to this disclosure is applied to an inkjet type image forming apparatus but is not limited thereto. For example, the sheet conveying device according to this disclosure may also be applicable to an electrophotographic image forming apparatus.

Figure 26:
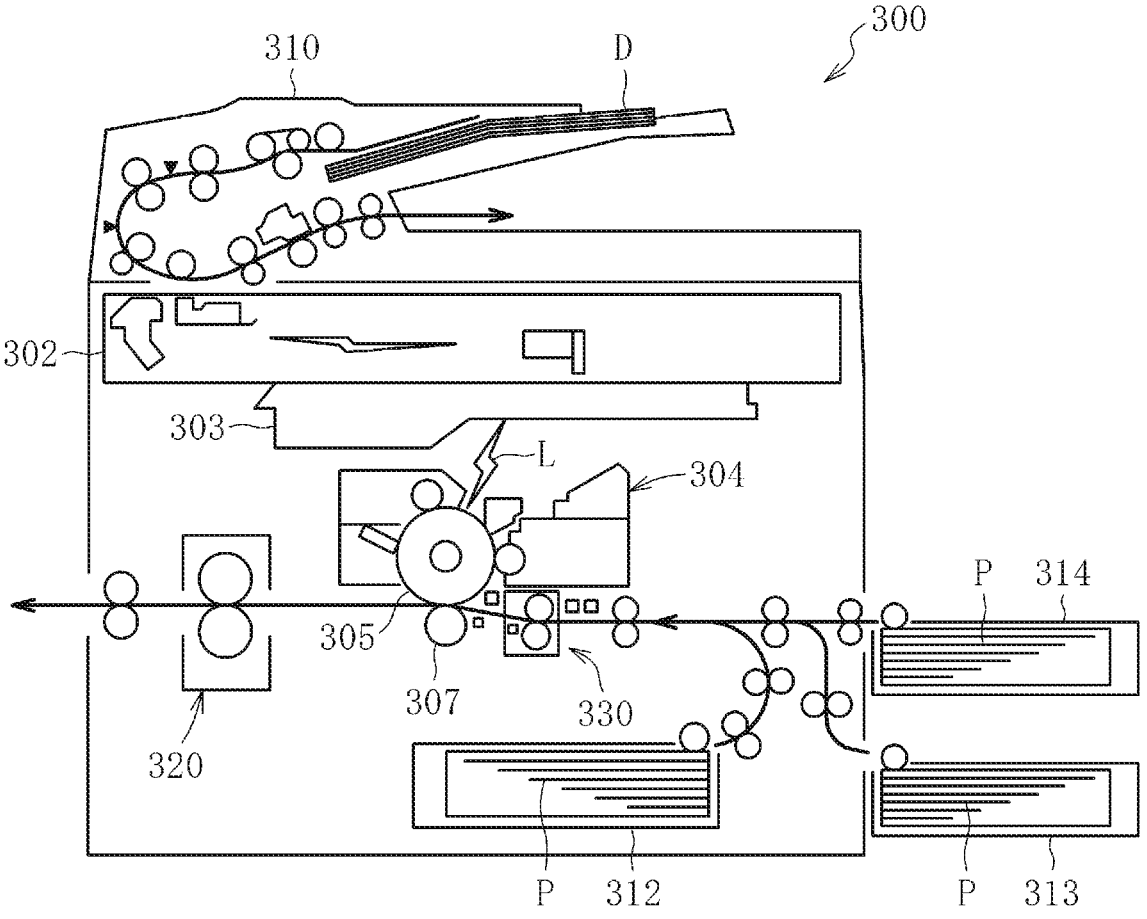
FIG. 26 is a diagram illustrating an electrophotographic image forming apparatus including the sheet conveying device according to the embodiments of this disclosure.

FIG. 26 is a diagram illustrating an electrophotographic image forming apparatus 300 including a sheet conveying device according to an embodiment of this disclosure.

In FIG. 26, the electrophotographic image forming apparatus 300 includes a document reading device 302, an exposure device 303, a developing device 304, a photoconductor drum 305, a transfer unit (an image forming device) 307, a document conveying device 310, a first sheet feed tray 312, a second sheet feed tray 313, a third sheet feed tray 314, a fixing device 320 and a sheet conveying device 330. The document reading device 302 optically reads image data of an original document D. The exposure device 303 emits an exposure light L based on the image data read by the document reading device 302 to the photoconductor drum 305. The developing device 304 forms a toner image on the surface of the photoconductor drum 305. The transfer unit 307 transfers the toner image formed on the surface of the photoconductor drum 305 onto a sheet P. The document conveying device 310 functions as a document feeder that conveys the original document D set on a document tray or a document loader to the document reading device 302. Each of the first sheet feed tray 312, the second sheet feed tray 313 and the third sheet feed tray 314 contains the sheet P therein. The fixing device 320 fixes an unfixed image formed on the sheet P to the sheet P by application of heat and pressure. The sheet conveying device 330 conveys the sheet P fed by any one of the first sheet feed tray 312, the second sheet feed tray 313 and the third sheet feed tray 314.

A description is given of the basic operations of the electrophotographic image forming apparatus 300.

When the document D is conveyed by the document conveying device 310 in the direction indicated by arrow in FIG. 26 and the image data of the document D is read by the document reading device 302, based on the image information, the exposure device 303 emits the exposure light L based on the image data to the charged surface of the photoconductor drum 305. Consequently, an electrostatic latent image is formed on the surface of the photoconductor drum 305. Subsequently, the developing device 304 supplies toner onto the electrostatic latent image formed on the photoconductor drum 305, so that the electrostatic latent image on the photoconductor drum 305 is developed into a toner image (visible image). The sheet P fed from any one of the first sheet feed tray 312, the second sheet feed tray 313 and the third sheet feed tray 314 is conveyed to the transfer unit 307 by the sheet conveying device 330, so that the toner image formed on the photoconductor drum 305 is transferred onto the sheet P. Thereafter, the sheet P is conveyed to the fixing device 320. After the toner image is fixed in the fixing device 320, the sheet P is discharged to the outside of the electrophotographic image forming apparatus 300.

In such an electrophotographic image forming apparatus 300, the conveying speed of the sheet P is to be adjusted such that the sheet P reaches the transfer unit 307 at a timing synchronized with movement of the toner image formed on the photoconductor drum 305. Therefore, by applying a sheet conveying device conveying device similar to the above-described embodiment as the sheet conveying device 330 that conveys the sheet P to the transfer unit 307, the sheet conveyance timing of the sheet P is controlled with high accuracy while the positional deviation of the sheet P is corrected, so as to convey the sheet P to the transfer unit 307.

Further, the sheet conveying device according to this disclosure is also applicable to a post processing device that performs stapling and folding to the sheet after an image has been transferred onto the sheet.

Figure 27:
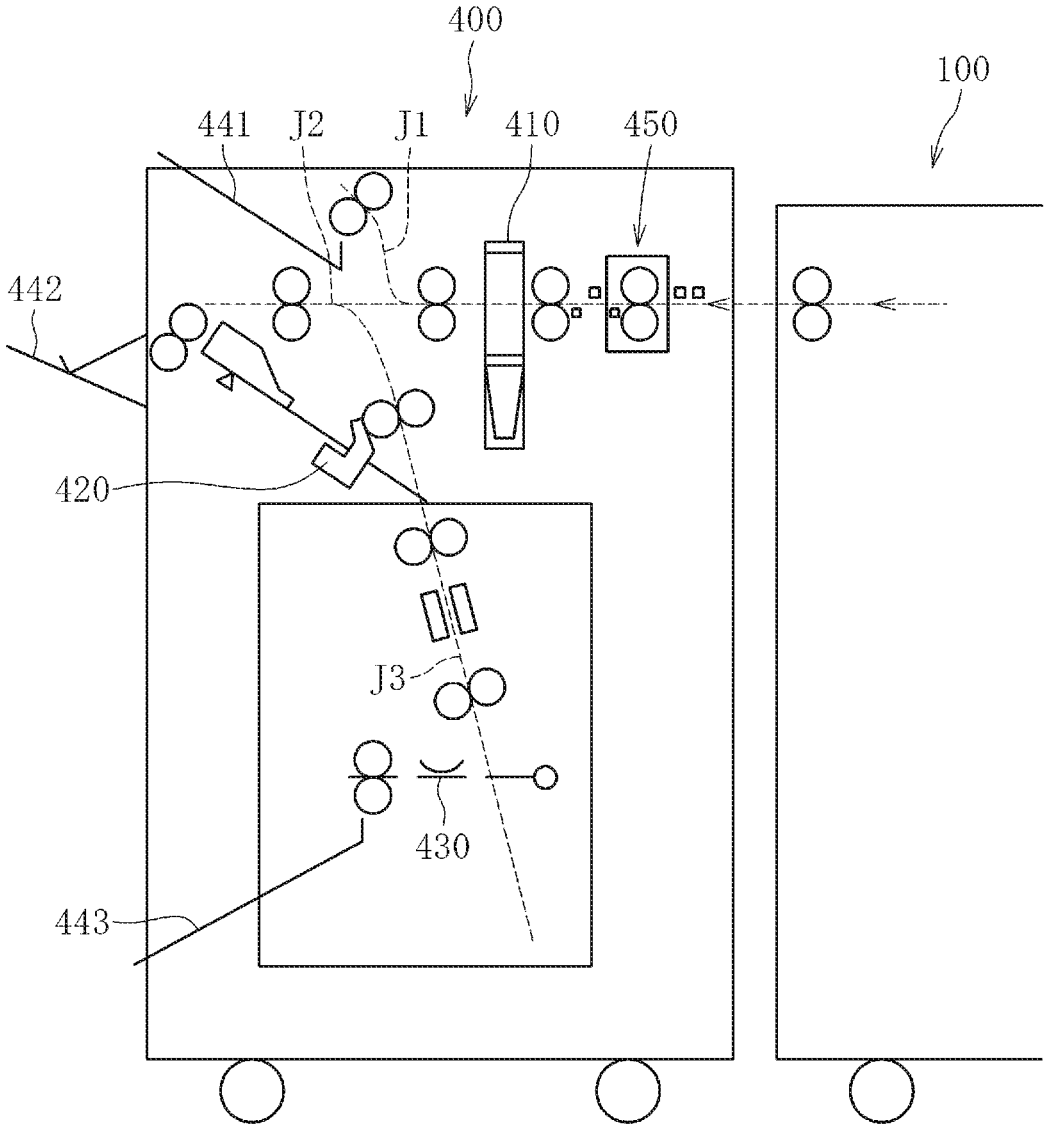
FIG. 27 is a schematic diagram illustrating an entire configuration of a post processing device.

Now, a description is given of a post processing device 400 to which this disclosure is applied, with reference to FIG. 27. FIG. 27 is a schematic diagram illustrating an entire configuration of the post processing device 400.

The post processing device 400 illustrated in FIG. 27 includes a punching device 410, a stapling device 420, a sheet folding device 430, multiple sheet trays, specifically, a first sheet tray 441, a second sheet tray 442 and a third sheet tray 443, and a sheet conveying device 450. The punching device 410 performs a punching process to a sheet. The stapling device 420 performs a binding process to the sheet. The sheet folding device 430 performs a center folding process. The first sheet tray 441, the second sheet tray 442 and the third sheet tray 443 function as multiple sheet loaders, which are a first sheet tray 441, a second sheet tray 442 and a third sheet tray 443. The sheet conveying device 450 conveys the sheet from the image forming apparatus 100 to the punching device 410. Further, the post processing device 400 performs different post processing processes by conveying the sheet conveyed from the image forming apparatus 100 to any one of three sheet conveyance passages, which are a first sheet conveyance passage J1, a second sheet conveyance passage J2 and a third sheet conveyance passage J3.

The first sheet conveyance passage J1 is a sheet conveyance passage to convey the sheet P to the first sheet tray 441 after the punching process is performed by the punching device 410 or without the punching process. The second sheet conveyance passage J2 is a sheet conveyance passage to convey the sheet P to the second sheet tray 442 after the stapling process is performed by the stapling device 420. The third sheet conveyance passage J3 is a sheet conveyance passage to convey the sheet P to the third sheet tray 443 after the center folding process is performed by the sheet folding device 430.

By applying a sheet conveying device similar to the sheet conveying device according to the above-described embodiments as the sheet conveying device 450 provided to the post processing device 400, the sheet is conveyed at a predetermined timing while the positional deviation of the sheet is being corrected. Therefore, the punching process, the accuracy of the binding process or the center folding process to be performed when the sheet is conveyed is enhanced.

Further, the sheet conveying device according to this disclosure is not limited to a sheet conveying device to convey sheets. The sheet conveying device according to this disclosure can be applied to a sheet conveying device that conveys recording media such as overhead projector (OHP) sheets and OHP films on which an image is formed or sheets such as original documents, as well as sheets including plain papers, thick papers, thin papers, coated papers, label papers and envelopes. Further, the sheet conveying device according to this disclosure can be employed to not only a sheet conveying device that conveys a recording medium and a sheet such as an original document, but also a sheet conveying device that conveys a conveyance target medium such as a printed circuit board.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a plurality of position detectors configured to detect a position of a sheet;

a position adjuster including a pair of rollers configured to, based on a detection result obtained by the plurality of position detectors, rotate around a shaft to change the position of the sheet while the pair of rollers grips the sheet under conveyance; and a leading end detector configured to detect a leading end of the sheet, the leading end detector including, a first leading end detector downstream of the pair of rollers, the first leading end detector configured to rotate with the pair of rollers, and a second leading end detector downstream of the first leading end detector and upstream from a receiving position where a conveyance rotary body directly receives the sheet conveyed by the pair of rollers of the position adjuster in a sheet conveying direction.

2. The sheet conveying device according to claim 1, wherein, based on the detection result obtained by the plurality of position detectors, the position adjuster is configured to:

rotate, during a pick up and hold operation, in a first direction to align the position adjuster normal with the sheet, and rotate, during an adjustment operation, in a second direction opposite the first direction, while gripping the sheet under conveyance, and wherein the leading end detector is configured to detect the leading end of the sheet prior to completion of the adjustment operation.

3. The sheet conveying device according to claim 2, wherein the plurality of position detectors is configured to redetect the position of the sheet after the adjustment operation to generate an updated position of the sheet, and the position adjuster is configured to rotate in a rotation direction of the sheet based on the updated position of the sheet to adjust the position of the sheet while the position adjuster grips the sheet under conveyance, and the second leading end detector is configured to detect the leading end of the sheet after the position adjuster rotates based on the updated position of the sheet detected by the plurality of position detectors; and the sheet conveying device further comprises:

circuitry configured to change a conveying speed of the sheet, according to detection of the leading end of the sheet by the second leading end detector.

4. The sheet conveying device according to claim 1, further comprising:

circuitry configured to change a conveying speed of the sheet, according to detection of the leading end of the sheet by the second leading end detector.

5. The sheet conveying device according to claim 4, wherein a distance from the second leading end detector to the receiving position is an integral multiple of a roller circumference of the pair of rollers.

6. The sheet conveying device according to claim 1, wherein the first leading end detector is adjacent to the shaft.

7. The sheet conveying device according to claim 1, wherein a distance from the first leading end detector to the receiving position is an integral multiple of a roller circumference of the pair of rollers.

8. An image forming apparatus comprising:

the sheet conveying device according to claim 1.

9. The sheet conveying device according to claim 1, wherein the sheet conveying device is configured to convey a plurality of sheets including a first sheet and a second sheet, and the first leading end detector is configured to rotate with the position adjuster to cause, during a pick up operation, the first leading end detector to have a same alignment with the first sheet and the second sheet irrespective of an alignment of the plurality of sheets with respect to the sheet conveying direction.

10. The sheet conveying device according to claim 1, wherein the sheet conveying device further comprises:

a holding body configured to hold the pair of rollers, to rotate in a rotation direction of the sheet about the shaft, the holding body having the first leading end detector attached thereto to cause the first leading end detector to rotate with the position adjuster about the shaft.

11. The sheet conveying device according to claim 10, wherein the shaft resides within a lateral guide portion to cause the holding body to be configured to move laterally in a width direction, the width direction being perpendicular to a sheet conveying direction of the sheet.

12. The sheet conveying device according to claim 1, wherein the plurality of position detectors includes a pair of upstream position detectors and a downstream position detector, and wherein the pair of upstream position detectors is upstream of the position adjuster and the first leading end detector in a sheet conveying direction, and the downstream position detector is downstream of same in the sheet conveying direction.

13. The sheet conveying device according to claim 12, further comprising:

a third leading end detector upstream of the position adjuster and the first leading end detector in the sheet conveying direction.

14. The sheet conveying device according to claim 13, wherein the third leading end detector is upstream of the position adjuster and the first leading end detector and downstream of the pair of upstream position detectors in the sheet conveying direction.

15. The sheet conveying device according to claim 1, wherein the sheet conveying device further comprises:

circuitry configured to perform a primary correction operation by, calculating a first displacement amount of the sheet based on the position of the sheet detected by a pair of upstream position detectors of the plurality of position detectors, moving the position adjuster in a first width direction and rotating the position adjuster in a first rotational direction based on the first displacement amount to cause the position adjuster to be normal with the leading end of the sheet, instructing the pair of rollers to grip the sheet and begin conveying the sheet in a sheet conveyance direction, receiving an indication that the first leading end detector has detected the leading end of the sheet after the position adjuster has begun conveying the sheet in the sheet conveyance direction, determining a target conveyance timing based on at least the indication from the first leading end detector, and moving the position adjuster in a second width direction and rotating the position adjuster in a second rotational direction while the position adjuster grips the sheet, the second width direction and the second rotational direction being opposite the first width direction and the first rotational direction, respectively.

16. The sheet conveying device according to claim 15, wherein the circuitry is further configured to perform a secondary correction operation by, calculating a second displacement amount of the sheet based on the position of the sheet detected by one of the pair of upstream position detectors and a downstream position detector of the plurality of position detectors, and moving the position adjuster in one of first width direction and the second width direction and rotating the position adjuster in one of the first rotational direction and the second rotational direction based on the second displacement amount.

17. The sheet conveying device according to claim 16, wherein the circuitry is further configured to perform a speed correction operation by, receiving an indication that the second leading end detector has detected the leading end of the sheet after performing the secondary correction operation, and changing a conveying speed of the sheet based on the indication from the second leading end detector.

18. The sheet conveying device according to claim 1, further comprising:

circuitry configured to perform a speed correction operation after performing a primary correction operation and a secondary correction operation, the primary correction operation being based on position data from a pair of upstream position detectors of the plurality of position detectors, and the secondary correction operation being based on position data from one of the pair of upstream position detectors and a downstream position detector, the speed correction operation including changing a conveying speed of the sheet based on an indication that the second leading end detector has detected the leading end of the sheet.

19. The sheet conveying device of claim 1, wherein the pair of rollers are configured to, convey the sheet in a sheet conveyance direction while gripping the sheet in response to the leading end detector detecting the leading end of the sheet, and thereafter, based on the detection result obtained by the plurality of position detectors, rotate in a rotation direction of the sheet while the pair of rollers grips the sheet under conveyance to change the position of the sheet while simultaneously causing the first leading end detector downstream of the pair of rollers to rotate with the pair of rollers while the pair of rollers grip and rotate the sheet in the rotation direction of the sheet.

20. The sheet conveying device of claim 1, wherein the second leading end detector is provided closer to a center than the plurality of position detectors in a width direction orthogonal to the sheet conveying direction.

21. The sheet conveying device of claim 1, wherein a distance between the first leading end detector and the second leading end detector is changed when the first leading end detector rotates with the pair of rollers.

22. The sheet conveying device of claim 1, further comprising:

circuitry configured to change a rotation speed of the pair of rollers based on the detection of the leading end of the sheet by the first leading end detector.

23. The sheet conveying device of claim 22, further comprising:

a rotation speed detector configured to detect the rotation speed of the pair of rollers, wherein the circuitry is configured to control the rotation speed of the pair of rollers based on whether the rotation speed of the pair of rollers detected by the rotation speed detector is faster or slower than a target rotation speed of the pair of rollers.

24. The sheet conveying device according to claim 1, further comprising:

a third leading end detector upstream of the position adjuster and the first leading end detector in the sheet conveying direction.

25. A sheet conveying device comprising:

a plurality of position detectors configured to detect a position of a sheet;

a position adjuster including a pair of rollers configured to, based on a detection result obtained by the plurality of position detectors, rotate around a shaft to change the position of the sheet while the pair of rollers grips the sheet under conveyance;

a first leading end detector configured to detect a leading end of the sheet, the first leading end detector being downstream of the pair of rollers, the first leading end detector configured to rotate with the pair of rollers;

a second leading end detector downstream of the first leading end detector in the sheet conveying direction and upstream from a receiving position where a conveyance rotary body directly receives the sheet conveyed by the pair of rollers of the position adjuster in a sheet conveying direction; and circuitry configured to, perform a primary correction operation based on position data from a pair of upstream position detectors of the plurality of position detectors, perform a secondary correction operation based on position data from one of the pair of upstream position detectors and a downstream position detector, and perform a speed correction operation after performing the primary correction operation and the secondary correction operation, the speed correction operation including changing a conveying speed of the sheet based on detection of the leading end of the sheet by the first leading end detector.

26. The sheet conveying device of claim 25, wherein the circuitry is configured to change a rotation speed of the pair of rollers based on the detection of the leading end of the sheet by the first leading end detector.

27. The sheet conveying device of claim 26, further comprising:

a rotation speed detector configured to detect the rotation speed of the pair of rollers, wherein the circuitry is configured to control the rotation speed of the pair of rollers based on whether the rotation speed of the pair of rollers detected by the rotation speed detector is faster or slower than a target rotation speed of the pair of rollers.

28. An image forming apparatus comprising:

the sheet conveying device according to claim 25.

29. A sheet conveying device comprising:

a plurality of position detectors configured to detect a position of a sheet;

a position adjuster including a pair of rollers configured to, based on a detection result obtained by the plurality of position detectors, rotate around a shaft to change the position of the sheet while the pair of rollers grips the sheet under conveyance;

a first leading end detector configured to detect a leading end of the sheet, the first leading end detector being downstream of the pair of rollers, the first leading end detector configured to rotate with the pair of rollers;

a second leading end detector downstream of the first leading end detector in the sheet conveying direction and upstream from a receiving position where a conveyance rotary body directly receives the sheet conveyed by the pair of rollers of the position adjuster in a sheet conveying direction; and a holding body configured to hold the pair of rollers, to rotate in a rotation direction of the sheet about the shaft, the holding body having the first leading end detector attached thereto to cause the first leading end detector to rotate with the position adjuster about the shaft.

30. The sheet conveying device of claim 29, further comprising:

circuitry configured to change a rotation speed of the pair of rollers based on the detection of the leading end of the sheet by the first leading end detector.

31. The sheet conveying device of claim 30, further comprising:

a rotation speed detector configured to detect the rotation speed of the pair of rollers, wherein the circuitry is configured to control the rotation speed of the pair of rollers based on whether the rotation speed of the pair of rollers detected by the rotation speed detector is faster or slower than a target rotation speed of the pair of rollers.

32. An image forming apparatus comprising:

the sheet conveying device according to claim 29.

33. A sheet conveying device comprising:

a plurality of position detectors configured to detect a position of a sheet;

a position adjuster including a pair of rollers configured to, based on a detection result obtained by the plurality of position detectors, rotate around a shaft to change the position of the sheet while the pair of rollers grips the sheet under conveyance; and a plurality of leading end detectors configured to detect a leading end of the sheet, the plurality of leading end detectors including a first leading end detector, a second leading end detector and a third leading end detector, the first leading end detector and the second leading end detector being downstream of the pair of rollers with the second leading end detector being upstream from a receiving position where a conveyance rotary body directly receives the sheet conveyed by the pair of rollers of the position adjuster in a sheet conveying direction, the first leading end detector configured to rotate with the pair of rollers, and the third leading end detector being upstream of the position adjuster and the first leading end detector in the sheet conveying direction.

34. The sheet conveying device of claim 33, further comprising:

circuitry configured change a rotation speed of the pair of rollers based on the detection of the leading end of the sheet by the first leading end detector.

35. The sheet conveying device of claim 34, further comprising:

a rotation speed detector configured to detect the rotation speed of the pair of rollers, wherein the circuitry is configured to control the rotation speed of the pair of rollers based on whether the rotation speed of the pair of rollers detected by the rotation speed detector is faster or slower than a target rotation speed of the pair of rollers.

36. An image forming apparatus comprising:

the sheet conveying device according to claim 33.

37. A sheet conveying device comprising:

a pair of sheet conveying rollers to convey a sheet;

a plurality of position detectors configured to detect a position of the sheet;

a position adjuster including a pair of rollers configured to, based on a detection result obtained by the plurality of position detectors, rotate around a shaft to change the position of the sheet while the pair of rollers grips the sheet under conveyance; and a plurality of leading end detectors configured to detect a leading end of the sheet, the plurality of leading end detectors including an upstream leading end detector and a downstream leading end detector, the upstream leading end detector being provided upstream of the pair of rollers and downstream of the pair of sheet conveying rollers such that the upstream leading end detector is upstream from a receiving position where a conveyance rotary body directly receives the sheet conveyed by the pair of rollers of the position adjuster in a sheet conveying direction, and the downstream leading end detector being provided downstream of the pair of rollers, the downstream leading end detector configured to rotate with the pair of rollers, wherein at least one of the plurality of position detectors is between the pair of sheet conveying rollers and the position adjuster, and a distance from at least one of the plurality of position detectors that is between the pair of sheet conveying rollers and the position adjuster is farther from a center of a conveyance path than the upstream leading end detector is positioned from the position adjuster in the sheet conveying direction.

38. The sheet conveying device of claim 37, wherein a distance between the upstream leading end detector and the downstream leading end detector is changed when the downstream leading end detector rotates with the pair of rollers.

39. The sheet conveying device of claim 37, further comprising:

circuitry configured change a rotation speed of the pair of rollers based on the detection of the leading end of the sheet by the downstream leading end detector.

40. The sheet conveying device of claim 39, further comprising:

a rotation speed detector configured to detect the rotation speed of the pair of rollers, wherein the circuitry is configured to control the rotation speed of the pair of rollers based on whether the rotation speed of the pair of rollers detected by the rotation speed detector is faster or slower than a target rotation speed of the pair of rollers.

41. An image forming apparatus comprising:

the sheet conveying device according to claim 37.

* * * * *